US007946074B2

(12) United States Patent
Nemec

(10) Patent No.: US 7,946,074 B2
(45) Date of Patent: May 24, 2011

(54) MACHINE GUN SIGHTING SYSTEM

(76) Inventor: William Joseph Nemec, Pittsburgh, PA (US)

( * ) Notice: Subject to any disclaimer, the term of this patent is extended or adjusted under 35 U.S.C. 154(b) by 0 days.

(21) Appl. No.: 12/108,195

(22) Filed: Apr. 23, 2008

(65) Prior Publication Data

US 2009/0038202 A1 Feb. 12, 2009

Related U.S. Application Data

(60) Provisional application No. 60/964,248, filed on Aug. 10, 2007.

(51) Int. Cl.
*F41G 1/00* (2006.01)

(52) U.S. Cl. ..... 42/137; 42/113; 42/128; 42/140

(58) Field of Classification Search ..... 42/137, 42/129, 140, 141
See application file for complete search history.

(56) References Cited

U.S. PATENT DOCUMENTS

| | | | | | |
|---|---|---|---|---|---|
| 870,272 | A | * | 11/1907 | Burton | 42/126 |
| 1,365,236 | A | * | 1/1921 | Fletcher et al. | 42/140 |
| 2,276,446 | A | * | 3/1942 | Louis | 42/140 |
| 2,336,107 | A | * | 12/1943 | Litschert | 42/126 |
| 2,336,108 | A | * | 12/1943 | Lowe | 42/137 |
| 2,864,168 | A | * | 12/1958 | Sampson | 42/137 |
| 3,165,836 | A | * | 1/1965 | Magardo | 42/137 |
| 3,626,597 | A | * | 12/1971 | Darrah | 42/137 |
| 4,127,943 | A | | 12/1978 | Tiritilli | |
| 4,264,123 | A | * | 4/1981 | Mabie | 359/600 |
| 4,536,966 | A | | 8/1985 | Engel | |
| 4,606,131 | A | | 8/1986 | Domian | |
| 4,686,770 | A | * | 8/1987 | Aigner | 42/140 |
| 4,691,442 | A | * | 9/1987 | Center | 42/140 |
| 5,533,292 | A | * | 7/1996 | Swan | 42/123 |
| 5,590,484 | A | * | 1/1997 | Mooney et al. | 42/111 |
| 5,930,906 | A | | 8/1999 | Howe et al. | |
| 5,983,774 | A | | 11/1999 | Mihaita | |
| 6,513,276 | B2 | * | 2/2003 | Mendoza-Orozco | 42/137 |
| 6,622,415 | B1 | * | 9/2003 | Canaday et al. | 42/140 |
| 6,860,056 | B2 | | 3/2005 | Howe | |
| 6,968,643 | B2 | | 11/2005 | Woodbury | |
| 7,181,882 | B2 | * | 2/2007 | Woodbury | 42/137 |
| 7,356,962 | B2 | * | 4/2008 | Swan | 42/147 |
| 2005/0188602 | A1 | * | 9/2005 | Swan | 42/147 |
| 2009/0038202 | A1 | * | 2/2009 | Nemec | 42/137 |
| 2009/0049734 | A1 | * | 2/2009 | Storch et al. | 42/136 |
| 2009/0071056 | A1 | * | 3/2009 | Storch et al. | 42/137 |

* cited by examiner

*Primary Examiner* — Michael Carone
*Assistant Examiner* — Samir Abdosh
(74) *Attorney, Agent, or Firm* — Thomas Lizzi; IP & Internet Law North, LLC

(57) ABSTRACT

A sighting system for a fire arm, e.g. machine gun includes front and rear sight assemblies. The rear sight assembly has a pivotal L-shaped member having two different sized apertures. Pivotal and windage lateral movements of the L-shaped member are achieved via a threaded shaft and a knob held in place via a detent screw/plunger assembly. The L-shaped member is secured in place via the detent plunger spring assembly. The front sight assembly is configured for windage lateral movement and has a sight post that is raised and lowered and secured in place via detent plunger spring assemblies. Another embodiment includes a rear sight assembly which may be configured for windage lateral movement. Detent plunger spring assemblies secure an aperture member of the rear sight assembly and the front sight assembly during operation of the fire arm, and the front sight assembly is configured for elevational and windage lateral movements.

34 Claims, 28 Drawing Sheets

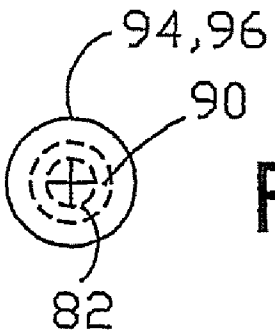
FIG. 8a
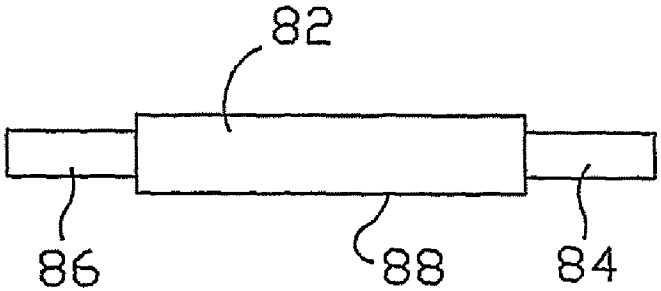
FIG. 8b
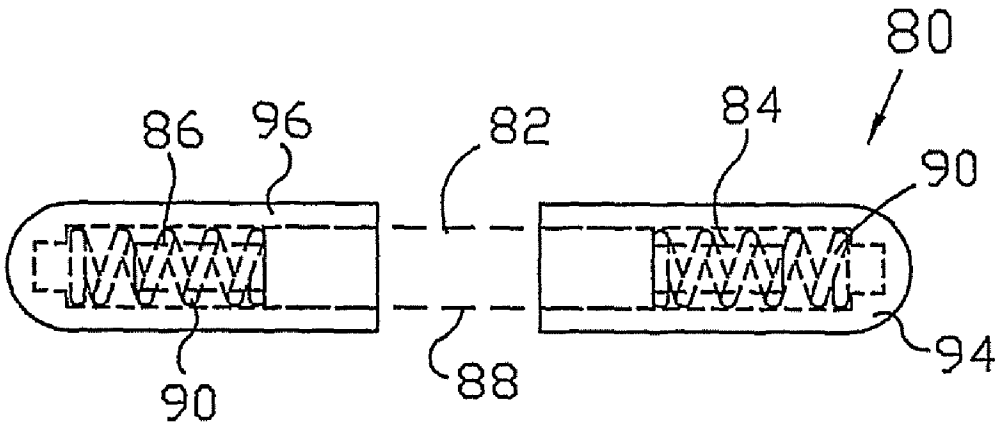

MACHINE GUN SIGHTING SYSTEM

CROSS REFERENCE TO RELATED PATENT APPLICATIONS

This application is based on U.S. Provisional Patent Application No. 60/964,248 filed Aug. 10, 2007, on which priority of this patent application is based and which provisional patent application is hereby incorporated by reference in its entirety.

BACKGROUND OF THE INVENTION

1. Field of the Invention

The invention relates to a sighting system for a machine gun, such as an M2HB, M3 flexible, which is a 50 caliber machine gun. More specifically, the invention relates to a sighting system having a rear sight assembly which is adjustable for sighting in long-range and short-range targets and a front sight assembly.

2. Description of Related Art

Rear and front sights are presently used on machine guns for sighting long-range and short-range targets. In this respect, both the rear sight and the front sight are mounted on the receiver of the machine gun. The rear sight is mounted at the rear end of the machine gun and the front sight is mounted at the front of the machine gun, closer to the target.

One such arrangement involves a front sight that is in a fixed position. The front sight has an arc housing mounted on a base which is mounted on a trunnion of the receiver. The housing defines an aperture and includes a sight post extending upwardly in the front sight aperture.

The rear sight of this aforesaid arrangement is attached to the upper receiver. The upright bracket may be attached to a rod which is operatively connected to a screw for rotation of the rod, and therefore, lateral movement of the bracket within the trunnion. The upright bracket may have an elongated slot having a slidable aperture and calibration marks along one of its surfaces for positioning the aperture relative to a target. The aperture is attached to an elevational screw which slides on a rail for setting the elevation and a leaf assembly transverses the screw on the bottom.

A disadvantage of the sighting system of the aforesaid arrangement for a machine gun is that the upright bracket of the rear sight can easily become askew on its threaded rod when the machine gun is being fired such that the aperture also becomes askew, thereby disturbing the line-of-sight of the target. A further disadvantage is that the rear sight does not provide different apertures for varying distant targets.

Additional examples of rear and/or front sights for various types of fire arms are disclosed in U.S. Pat. Nos. 4,127,943; 4,536,966; 5,930,906; 5,983,774; 6,860,056 B2; 6,968,643 B2; and 7,181,882 B2.

U.S. Pat. No. 7,181,882 B2 discloses a sighting system for a shotgun having a rear sight and a front sight. The rear sight has sight elements adaptable for "zeroing in" the same gun with different ammunition. The rear sight has windage and elevation adjustments for the sight elements so that multiple ammunition types having different trajectories may be fired accurately from a single firearm after zeroing in one of the sight elements for each of the different ammunition types. The sight elements may be connected to each other or to a common pivot arm or movable bracket so that moving one sight element into the sight path automatically removes the other from the line of vision. In one embodiment, one of the elements of the rear sight is a hollow ghost ring used to align shots taken with buckshot-type ammunition and another element is a V-shaped notch used to align shots taken with slug loads. These elements are attached to a pivoting L-shaped mount and form a single pivoting unit and are separated by a right angle. Consequently, flipping the V-shaped notch into the line-of-sight pivots the ghost ring out of the sight plane and vice versa. Applying slight pressure to the pivoting system flips the sights and claps, or other mechanisms may be desirable to fix the sights in a given position.

This design for the sighting system for a shotgun as disclosed in the above U.S. Pat. No. 7,181,882 B2 may be adequate for a shotgun and the other sighting systems of the prior art listed hereinabove may be adequate for the type of firearm they are used on; however, these sighting systems prove to be ineffective when used on a machine gun. That is, the sighting system for use on a machine gun needs to have a greater degree of adjustability for setting up a line-of-sight for a target. Also, since a machine gun is designed for continuous use and is a powerful, heavy weapon weighing close to 100 pounds, it creates a great thrust when operated. Also, the sights, particularly the rear sight close to the operator of the machine gun, needs to remain in place when the machine gun is continuously being fired so that the line-of-sight remains accurate even though the target may be moving quickly.

There is a need, therefore, in the art pertaining to machine guns, such as an M2HB, M3 flexible, which are 50 caliber machine guns, for an improved design of a sighting system having a front sight assembly and a rear sight assembly which allows for an increase in the percentage of hit rounds when the machine gun is operated and which also allows for a greater degree of adjustability compared to the prior art sighting systems used on firearms, including those described hereinabove.

SUMMARY OF THE INVENTION

The present invention has met this need. The present invention provides a sighting system for a machine gun that includes an adjustable front sight assembly and an adjustable rear sight assembly, both mounted on the top surface of a receiver of a machine gun. In a first embodiment, the front sight assembly includes a first aperture member having a sight post, a first base member fixed to the first aperture member and having a dovetail surface, and a second base member or dovetail base having a dovetail surface corresponding to and slidable within the dovetail surface of the first base member. The second base member is mounted into slots on top of the surface of a trunnion which is the forward section of the machine gun, and the first aperture member via the dovetail base connection can be moved in a lateral direction perpendicular to the longitudinal plane of the top surface of the trunnion. The sight post has an upper needle portion which extends upwardly into the aperture defined by an upper arched portion of the aperture member and a lower elongated body member that extends downwardly into the lower portion of the first base member. The sight post is configured to be raised and lowered within the window of the first aperture member. This is accomplished by providing an external threaded portion on the elongated body of the sight post and by providing an annular elevation knob which encircles the elongated body of the sight post and which has a threaded portion on an inner annular surface that meshes with the external threaded portion on the elongated body of the sight post. Rotation of the elevation knob in one direction raises the sight post and rotation in an opposite direction lowers the sight post within the window of the first aperture member.

The rear sight assembly includes a base plate which is mounted along the longitudinal plane of the top rear receiver of the machine gun. Fastened to this elongated base plate are a base support cradle and a second aperture member which includes an L-shaped member, pivotally mounted in the base support cradle. A first leg of the L-shaped member has an upper circular portion with an aperture and a second leg of the L-shaped member has the shape of an inverted "V" with an aperture. The aperture of the first leg generally is greater than the aperture of the second leg. Pivoting the first leg having the larger aperture into the line-of-sight pivots the second leg having the smaller aperture out of the sight plane and vice versa. The L-shaped member is connected to an elongated shaft extending through a first longitudinal opening in the lower portion of the L-shaped member and through the support members of the base support cradle for the pivotal movement of the first leg and the second leg into and out of the sight plane. This pivotal movement of the L-shaped member, which generally is about 90 degrees, is done manually by the operator of the machine gun. The elongated shaft connecting the L-shaped member to the base support cradle has a threaded portion which corresponds to an internal threaded portion in the first longitudinal opening of the lower portion of the L-shaped member. This elongated shaft is operatively connected to an external knob which rotates the shaft and causes the L-shaped member to move laterally along the length of the shaft for lateral windage movement of the L-shaped member relative to the base support cradle and perpendicularly relative to the longitudinal plane of the top surface of the receiver of the machine gun.

The lower portion of the L-shaped member also has a second longitudinal opening located adjacent to the first longitudinal opening. A detent plunger spring assembly extends through this second longitudinal opening. This detent plunger spring assembly is spring biased and includes two opposed plunger members separated by a spring. The plunger members extend out of the second longitudinal opening of the lower portion of the L-shaped member on either side of the L-shaped member and are configured to engage into openings in the two sidewalls of the support members of the base support cradle. Each sidewall has two such openings which are located at a 90 degree angle relative to each other. Thus, when the L-shaped member is manually pivoted 90 degrees from a first position to a second position within the sidewalls of the base support cradle, the two plunger members are forced inwardly toward each other to become disengaged from a first set of openings, i.e., one opening on each of the two sidewalls of support members of the base support cradle, and then are forced outwardly to engage the second set of openings, i.e., one opening on each of the two sidewalls of the support members of the base support cradle, which are located at a 90 degree angle relative to the first set of openings. This detent plunger spring assembly registers and retains the L-shaped pivotal member in position within the base support cradle and still allows the L-shaped pivotal member to be moved laterally for windage purposes. A detent screw/plunger assembly located within the windage screw knob engages notches located in a bushing to prevent the rotation of the knob and therefore the elongated shaft.

A second embodiment of a sighting system of the invention includes a front sight assembly and a rear sight assembly. The rear sight assembly can be pivoted upwardly in an operative position or it can be pivoted downwardly longitudinally along the receiver supporting the machine gun. In both instances, an aperture member is fixed in position via a detent plunger spring arrangement which includes a first detent plunger spring assembly and a second detent plunger spring assembly, each located in a leg member of the L-shaped member of the aperture member. The detent plunger spring assemblies for this rear sighting assembly are similar to those used in the rear sight assembly of the first embodiment. In this second embodiment, the rear sight assembly may be non-movable or it may be movable. In the latter instance, the aperture member is configured for windage lateral movement along a shaft extending through the aperture member, and a windage screw assembly including a knob is attached to an end of the shaft. Rotation of the knob forces the aperture member to move along a threaded portion of the shaft and moves the aperture member to the right and the left of a base support cradle which supports the aperture member.

The front sight assembly is configured for windage lateral movement and elevational movement. The windage lateral movement is accomplished via a windage screw assembly similar to that for the rear sight assembly for laterally moving an aperture member of the front sight assembly and the aperture member, and its sight post is retained with its base support cradle and fixed in this position via a detent plunger spring arrangement having two detent plunger spring assemblies similar to the aperture member of the rear sight assembly. The aperture member is pivotally connected to the base support cradle and is configured to be pivoted at a 90 degree angle for stowing purposes and in an opposite pivotal position for operation of the machine gun. The aperture member includes a threaded elongated shaft and a locking nut knob is mounted around the threaded elongated shaft. The locking nut knob locks the aperture in a fixed position. Elevation of the aperture is achieved by unlocking the nut knob and rotating the aperture in a clockwise or counterclockwise direction. The aperture member and its sight post are held in a desired elevational position via V-shaped head plunger assemblies located diametrically opposite each other relative to the length of the threaded elongated shaft of the aperture member. The V-shaped head of these plunger assemblies engage in an elongated V-groove in the threaded elongated shaft of the aperture member to lock the aperture member and its sight post in a desired elevational position.

It is therefore an object of the invention to provide an improved design for a rear sight assembly and a front sight assembly of a sighting system for a powerful firearm such as a machine gun, e.g., an M2HB, M3 flexible which are 50 caliber machine guns, weighing close to 100 pounds, wherein the sight line remains fixed and on target regardless of the speed of the target or the firing frequency of the machine gun. More specifically, in the invention, the number of rounds that can be hit are increased from about 10% to about 90% compared to the machine guns of the prior art using prior art sighting systems.

It is a further object of the invention to provide a heavy-duty mechanical rear sight assembly and a heavy-duty mechanical front sight assembly for a powerful firearm, e.g., a machine gun, wherein the front sight assembly can be moved laterally for windage, and the sight post can be adjusted to be raised and lowered for elevation, and wherein the rear sight assembly has a fold-down member or a pivotal member that provides different-sized apertures corresponding to the varying distances of the target. The pivotal member can be moved laterally for windage purposes and can be fixed in place during continuous operation of the firearm.

It is still a further object of the invention to provide a powerful firearm such as a machine gun, with an adequate rear sight assembly including a pivotal member. The pivotal member provides at least two different sized apertures corresponding to the different distances of the target and the different trajectories of the ammunition and at least one detent plunger spring assembly on at least the rear sight assembly.

The detent plunger spring assembly registers and retains the pivotal member into position when the pivotal member is forced from a first position to a second position and still allows lateral movement of the pivotal member for windage purposes. The detent plunger spring assembly also fixes the pivotal member in position during continuous operation of the firearm.

A further object of the invention is to provide a sighting system for a machine gun which provides a rear sight assembly and a front sight assembly, both of which have a greater degree of adjustability for accommodating the varying distances of the target and the varying trajectories of the ammunition compared to the sighting system of the prior art for machine guns. The apertures of the rear sight assembly and the front sight assembly are spring biased into position and remain in a fixed position regardless of the frequency and number of times the machine gun is operated.

These and other objects and advantages of the invention will be made apparent from the following description taken together with the drawings.

BRIEF DESCRIPTION OF THE DRAWINGS

FIG. 8*a* is a front view of a detent plunger spring assembly which may be used as an alternate or replacement for the detent plunger spring assemblies for the aperture member of FIG. 6*a* and showing in phantom its components;

FIG. 8*b* is a front view of a guide rod of the detent plunger spring assembly of FIG. 8*a;*

DETAILED DESCRIPTION OF THE INVENTION

Figure 1:
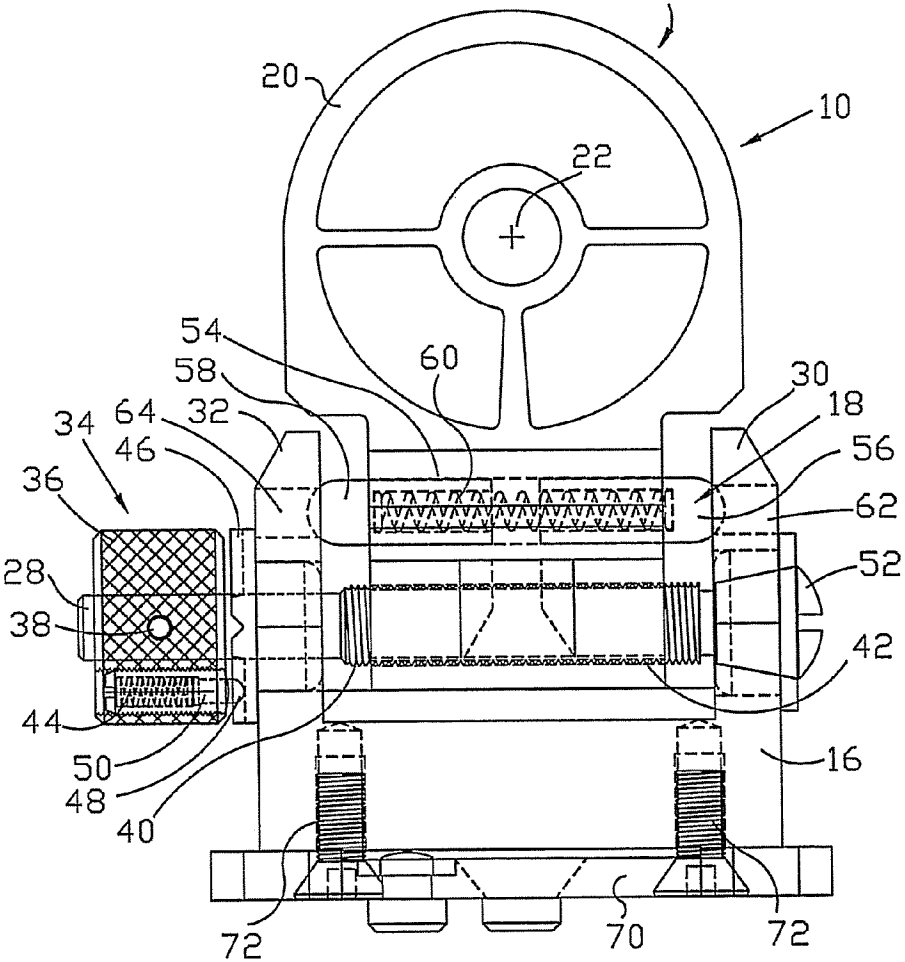
FIG. 1 is a front view of a movable rear sight assembly of a first embodiment of the invention illustrating a first leg of an L-shaped pivotal member of an aperture member and shown, in phantom, the internal structure and some components of the rear sight assembly.

A complete understanding of the present invention will be obtained from the following description taken in connection with the accompanying drawings, wherein like reference characters identify the parts throughout. For the purposes of the following description, the terms "above", "below", "top", "bottom" "vertical", "horizontal" and derivatives thereof refer to the invention as oriented in the drawings.

It is to be understood that the invention may assume alternative variations and step sequences, except where expressly specified to the contrary. It is also to be understood that the specific devices and processes illustrated in the attached drawings and described in the following specification are exemplary embodiments of the invention. Specific dimensions and other physical characteristics related to the embodiments disclosed herein are not considered to be limiting.

Figure 32:
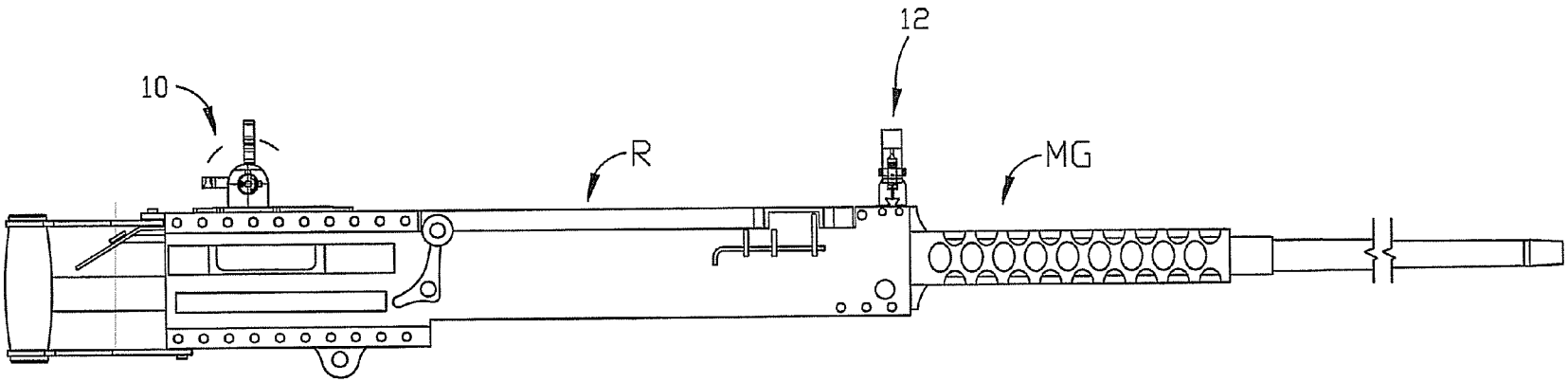
FIG. 32 is a side elevation view of FIG. 31.
Figure 33:
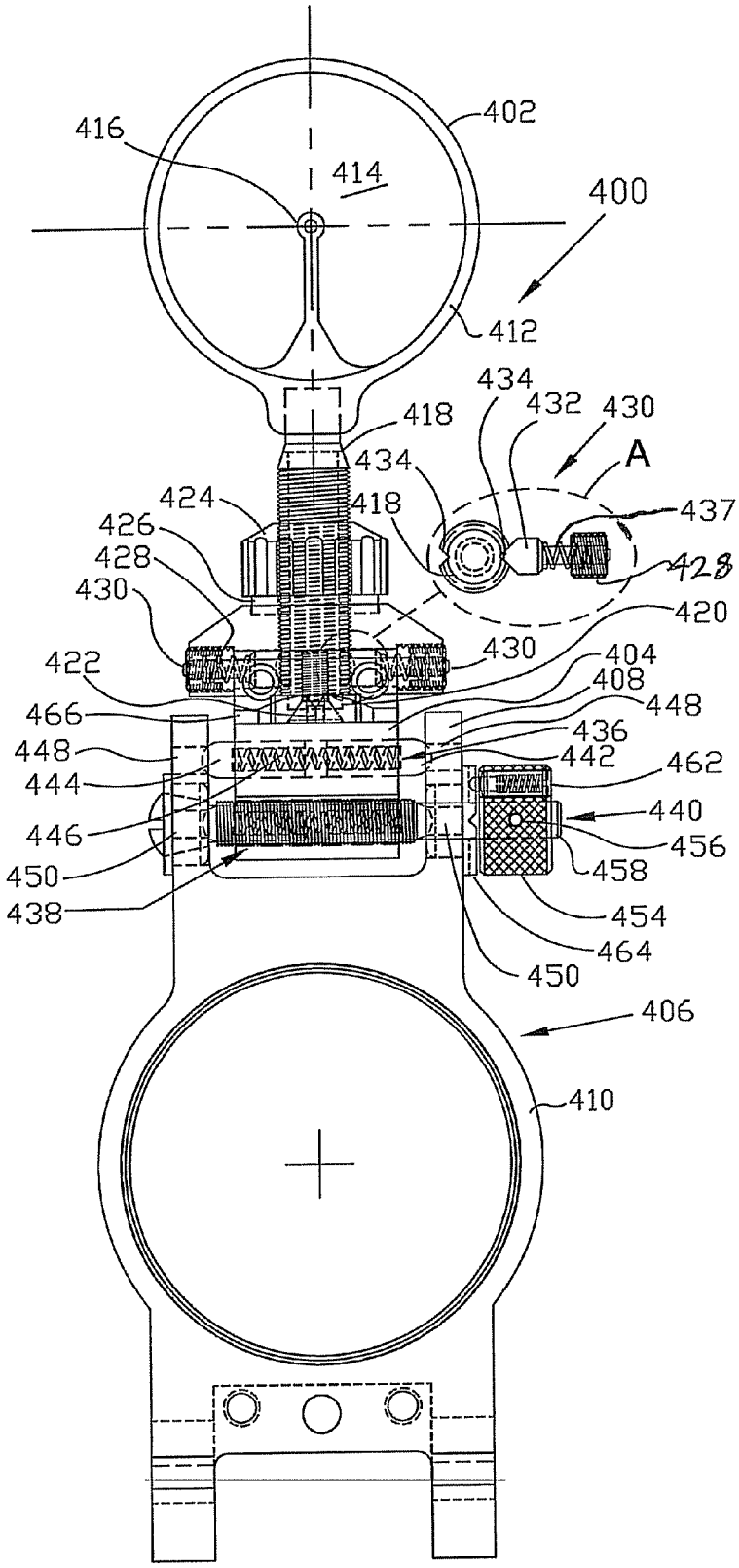
FIG. 33 is a full front view of a front sight assembly and its connection to a one-piece base support cradle and trunnion adapter construction for attaching the front sight assembly to a receiver of a machine gun front view and containing an enlarged view A which is rotated 90 degrees.
Figure 34:
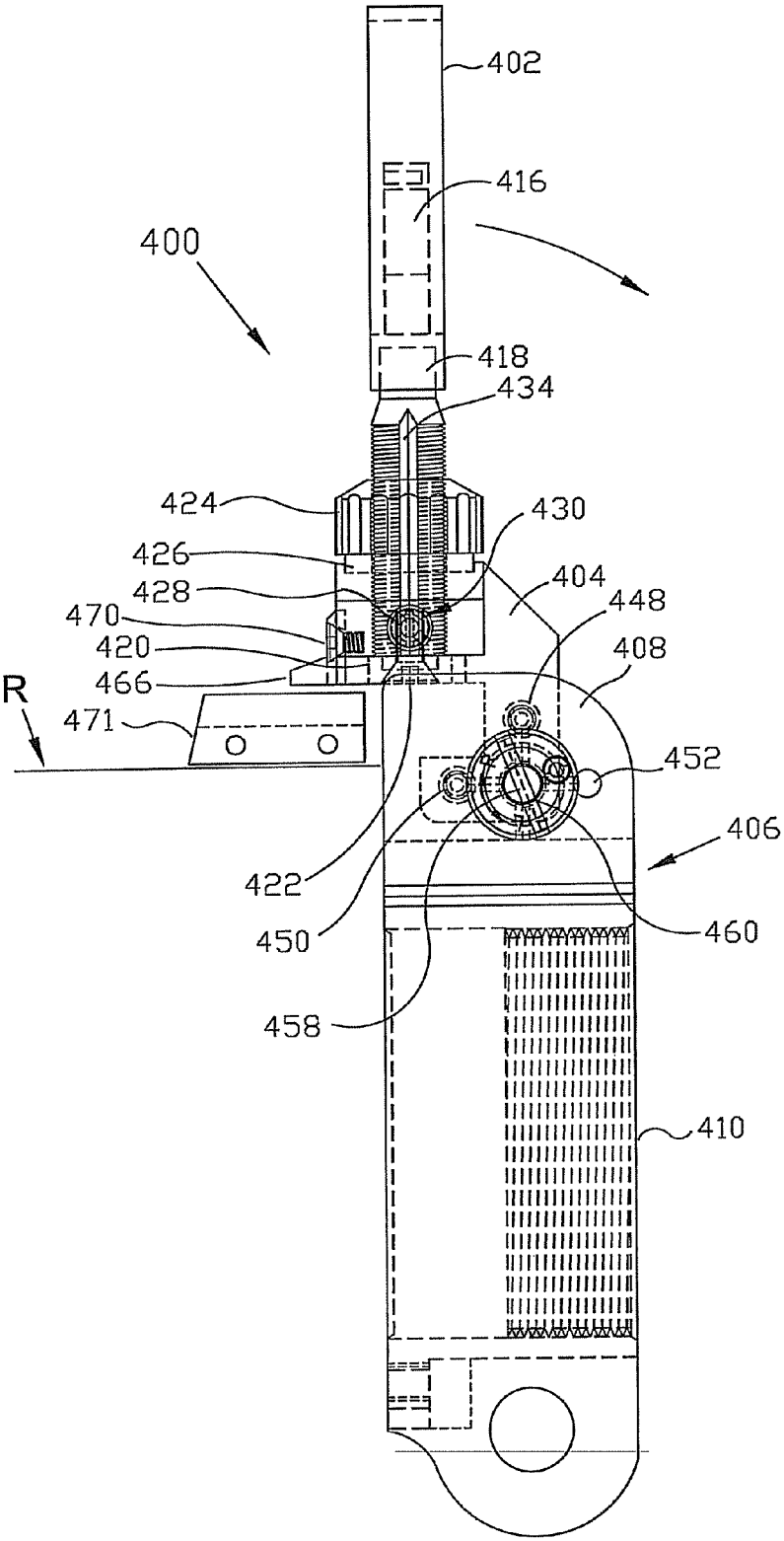
FIG. 34 is a full right-side view of the front sight assembly of FIG. 33.
Figure 35:
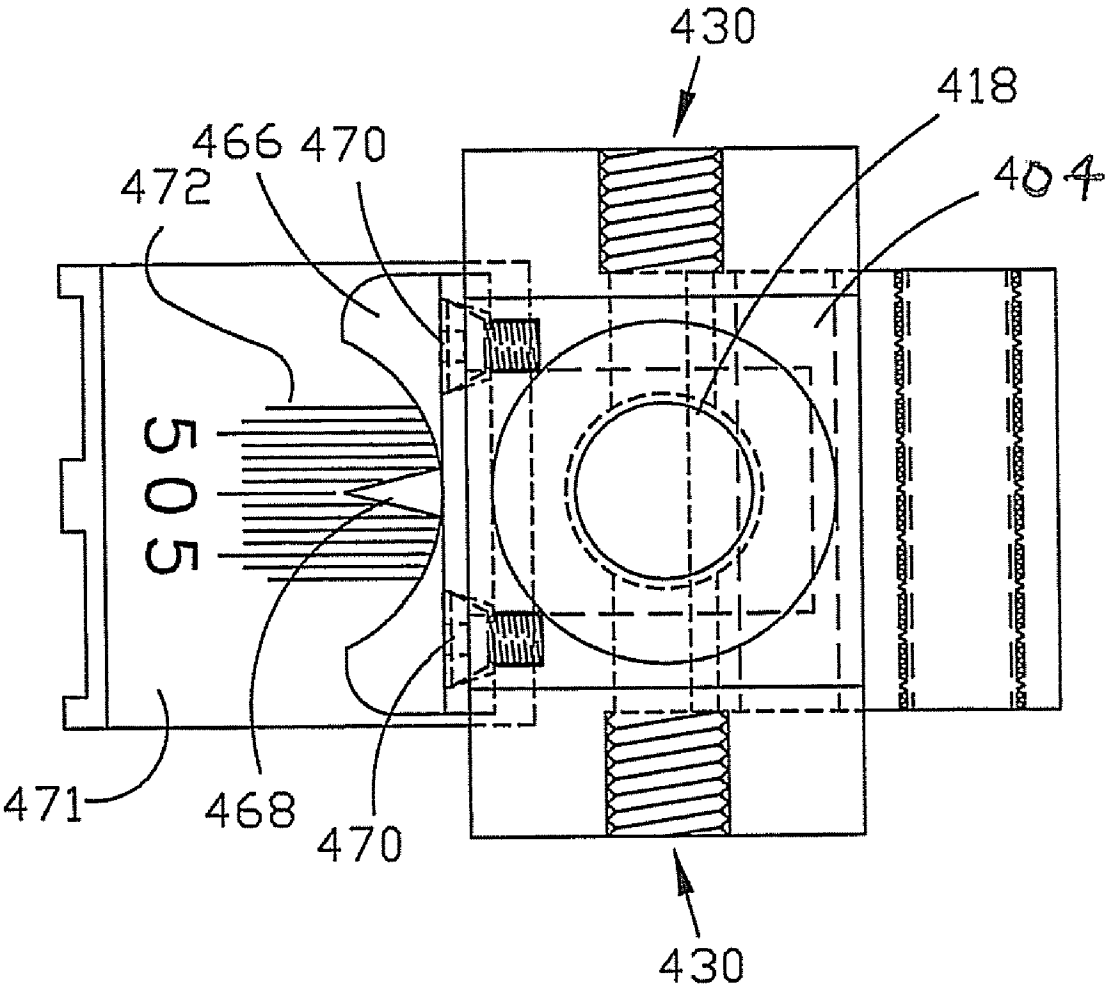
FIG. 35 is an enlarged top view of a windage indicator and windage plate used in the front sight assembly of FIGS. 33 and 34.

FIGS. 1-12 and FIGS. 31-32 pertain to a first embodiment of a sighting system of the invention and may find particular application on an M2HB machine gun. FIGS. 13*a*-30*b* pertain to a second embodiment of a sighting system of the invention and which find particular application on an M3 flexible machine gun. FIGS. 33-35 illustrate an alternative construction for the second embodiment of FIGS. 13*a*-30*b* wherein the base support cradle and the trunnion are a one-piece construction instead of a TIG welded construction.

Figure 31:
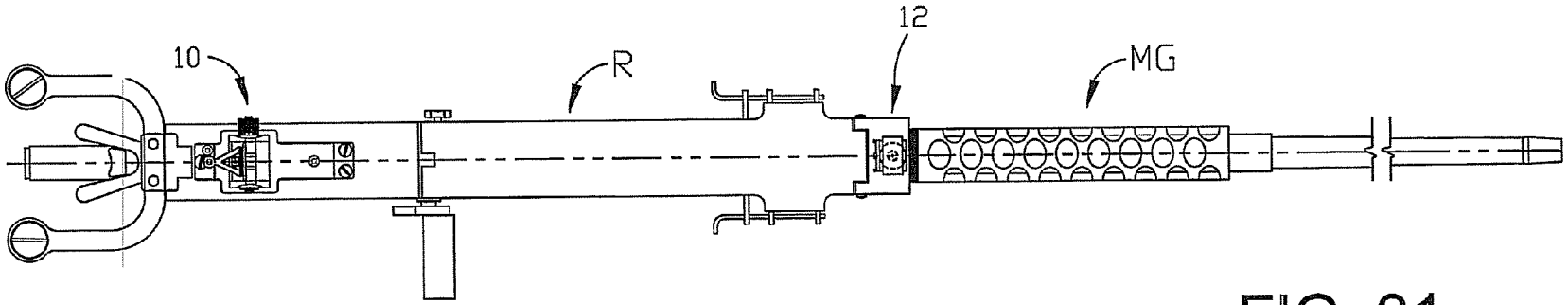
FIG. 31 is a top plan view illustrating the rear sight assembly and the front sight assembly of the first embodiment of FIGS. 1-12 mounted on a receiver supporting a machine gun.

Referring particularly to the first embodiment of the sighting system, FIGS. 1-7*c* illustrate a rear sight assembly 10 and FIGS. 9-12 illustrate a front sight assembly 12. FIGS. 31-32 illustrate the rear sight assembly 10 and the front sight assembly 12 being mounted on the top surface of a receiver R supporting a machine gun MG.

The rear sight assembly 10 of FIGS. 1-6*a* include an aperture member 14, a base support cradle 16 for supporting the aperture member 14 and a detent plunger spring assembly 18 connected to the aperture member 14 for registering and retaining the aperture member 14 in a fixed position within the base support cradle 16 and relative to a line-of-sight while a machine gun is being operated. As particularly shown in FIGS. 3, 4 and 5, the aperture member 14 is an L-shaped pivotal member having a first leg 20 and a second leg 24, and as particularly shown in FIGS. 1 and 2, the first leg 20 has an aperture 22 and the second leg 24 has an aperture 26. As can be appreciated from FIGS. 1 and 2, the aperture 22 is greater in diameter than that of aperture 26, the latter of which is also referred to as a rear peep sight or a piggy back aperture. That is, the diameter of aperture 22 may be about ⅜ of an inch while that of aperture 26 may be about 3/16 of an inch. Aperture 22 may be used for 100 to 500 yard targets and the piggy back aperture 26 may be used for 500 to 1200 yard targets.

Still referring particularly to FIGS. 1-6*a*, aperture member 14 is pivotally mounted in base support cradle 16 via an elongated shaft 28 which extends through support members 30, 32 of the base support cradle 16. As particularly shown in FIGS. 1, 2, 3 and 6*a*, the shaft 28 is a part of a windage screw assembly 34. Elongated shaft 28 extends outwardly from the support member 32 as shown to the left of FIGS. 1 and 2 and to the right of FIG. 6*a* and extends through a knurled knob 36, which, in turn, is secured to the end of elongated shaft 28 via a retaining roll pin 38. Elongated shaft 28 has a threaded external portion indicated at 40 in FIGS. 1, 2 and 6*a* which extends longitudinally through the aperture member 14 via a longitudinal opening 28*a* which is shown best in FIGS. 7*a*, 7*b* and 7*c*, and which engages with internal threads as shown at 42 in FIGS. 1, 2, 6*a* and FIG. 7*c*. Knurled knob 36 is rotatable and is used to rotate the elongated shaft 28 and its threaded portion 40 for the lateral windage movement of the aperture member 14 along the threaded portion 40 of the elongated shaft 28 and within the base support cradle 16.

Figure 2:
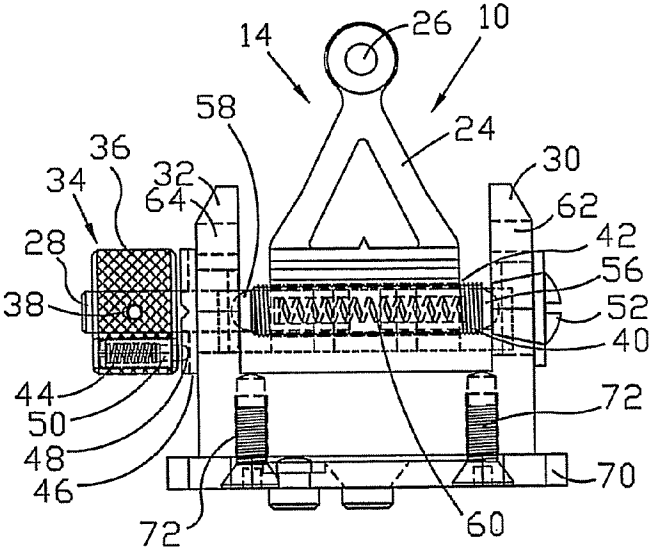
FIG. 2 is a front view of the rear sight assembly of FIG. 1 illustrating a second leg or the rear peep sight leg of the L-shaped pivotal member of the aperture member and shown, in phantom, the internal structure and some components of the rear sight assembly.
Figure 3:
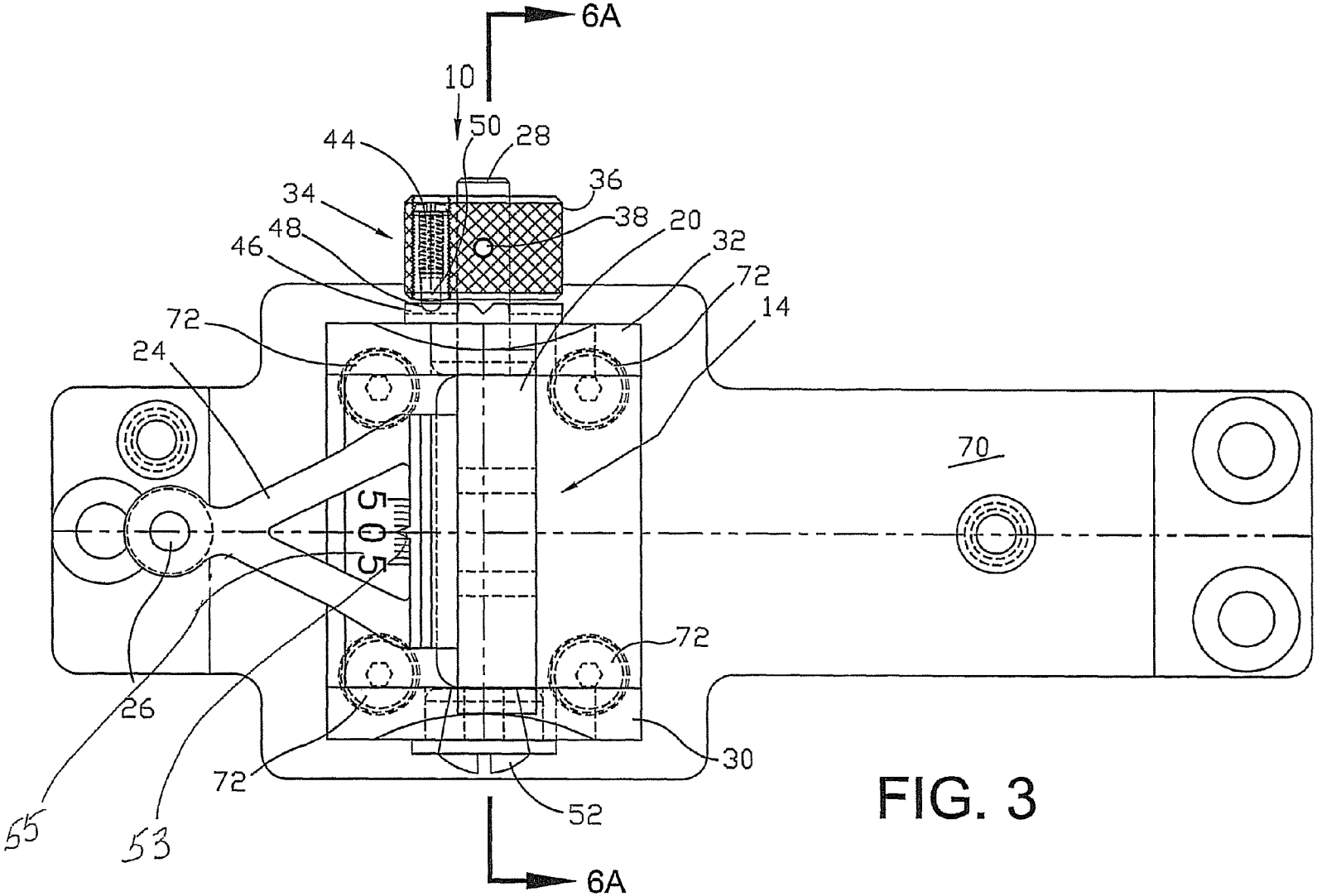
FIG. 3 is a top view of the rear sight assembly of FIG. 1 showing the L-shaped pivotal member of the aperture member in its positioning of FIG. 1.
Figure 6A:
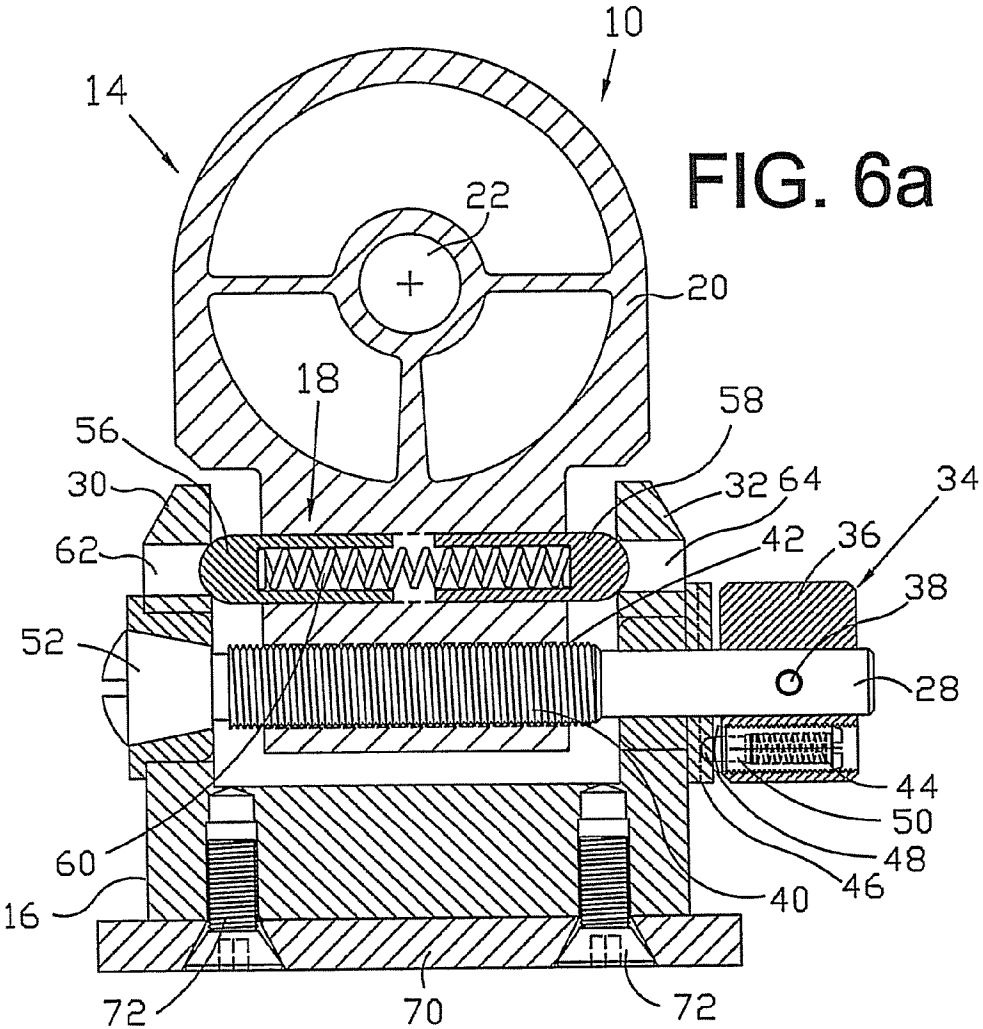
FIG. 6*a* is a cross-sectional view of the rear sight assembly taken along lines 6*a*-6*a* of FIG. 3.

Windage screw assembly 34 further includes a detent screw/plunger assembly 44 which is located in the knob 36 and a detent bushing member 46 shown best to the left of FIGS. 1 and 2, at the top of FIG. 3 and to the right of FIG. 6*a*. Detent bushing member 46 has a plurality of recesses, one indicated at number 48 for receiving and retaining a plunger 50 of the detent screw/plunger assembly 44, for preventing rotation of the knob 36 and the elongated shaft 28 of the windage screw assembly 34. As shown in FIGS. 1, 2, 3 and 6*a*, the end of the elongated shaft 28 opposite knob 36 contains a screw head 52 which is part of the elongated shaft 28. This screw head 52 holds and gives the windage screw assembly 34 a stronger lock up of the components of the windage screw assembly 34. The lateral windage movement of the aperture member 14 along the threaded portion 40 of the elongated shaft 28 is about 3/16 inch to the right and about 3/16 inch to the left with reference to FIGS. 1, 2 and 6*a* for a total movement of about ⅜ inch. The extent of the lateral windage movement of aperture member 14 is established via an indicator 53 (FIG. 7*a*) on aperture member 14 and windage plate 55 (FIG. 3) and alignment of indicator 53 with the lines numbered 5-0-5 on windage plate 55, which is supported on base plate 70 (FIG. 3).

Figures 4, 5:
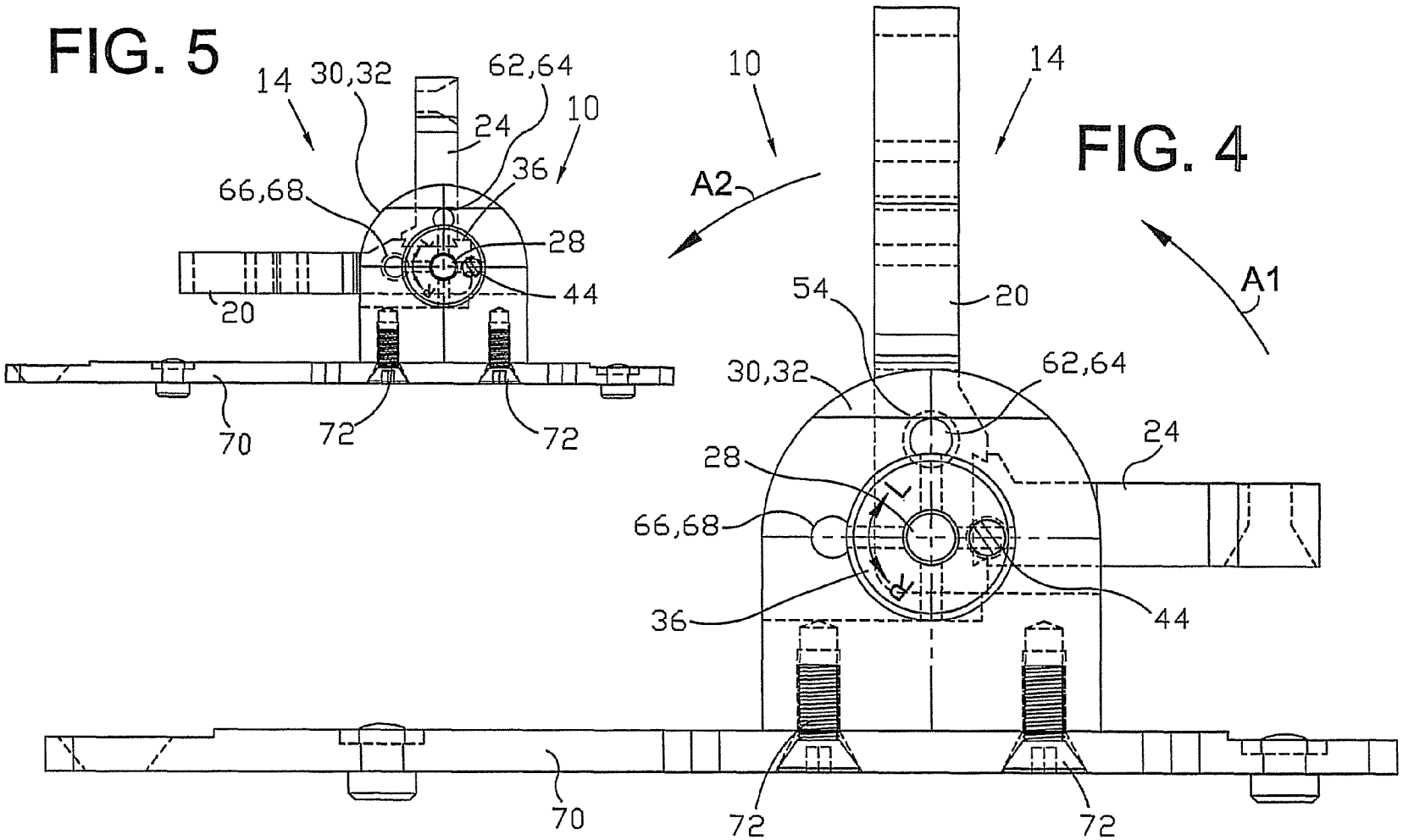
FIG. 4 is a left-side elevation view of the rear sight assembly of FIG. 1 showing the L-shaped pivotal member of the aperture member in its positioning of FIG. 3.
FIG. 5 is a smaller scale left-side elevation view of the rear sight assembly of FIG. 1 showing the L-shaped member of FIG. 4 pivoted 90 degrees to the left.

As shown in FIGS. 1, 7*a*, 7*b* and 7*c*, aperture member 14 further includes a longitudinal opening 54. As shown best in FIG. 1, longitudinal opening 54 receives the detent plunger spring assembly 18 which is operatively connected to the aperture member 14. As best shown in FIGS. 1 and 6*a*, the detent plunger spring assembly 18 includes at least two opposed plunger members 56, 58 and a spring 60 which extends between and into the two plunger members 56, 58. As best shown in FIGS. 1 and 6*a* plunger member 56 is received in an opening 62 of support member 30 and plunger member 58 is received in an opening 64 of support member 32 of base support cradle 16. Upon rotation of knob 36, elongated shaft 28 is rotated to pivot the first leg 20 of the L-shaped member of aperture member 14 into the position of FIG. 4 and then to pivot the second leg 24 of the L-shaped member of aperture member 14 into the position of FIG. 5, as indicated by arrows A1 and A2 in FIG. 4. During this pivotal movement of the L-shaped member of aperture member 14, the plunger members 56, 58 are forced out of openings 62, 64 of support members 30, 32, respectively, and inwardly via contact of the plunger members 56, 58 against the inner surfaces (FIGS. 1 and 2) of the support members 30, 32 to compress spring 60, and then plunger members 56, 58 are forced outwardly to engage similar openings 66, 68, respectively, located in support members 30, 32 as indicated in FIGS. 4 and 5. The rounded end of detent plunger member 56, 58 has a radius of about 0.25 inch.

As best shown in FIGS. 1-6*a*, base support cradle 16 is mounted on the base plate 70 via a plurality of retaining screws 72, four of which are shown in FIG. 3.

Figure 6B:
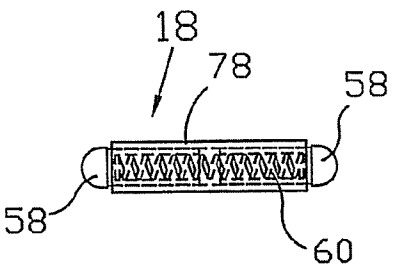
FIG. 6*b* is a front view of a detent plunger spring assembly for the aperture member of FIG. 6*a* which may be used to repair the detent plunger spring assembly of FIG. 1.
Figures 7A, 7B, 7C:
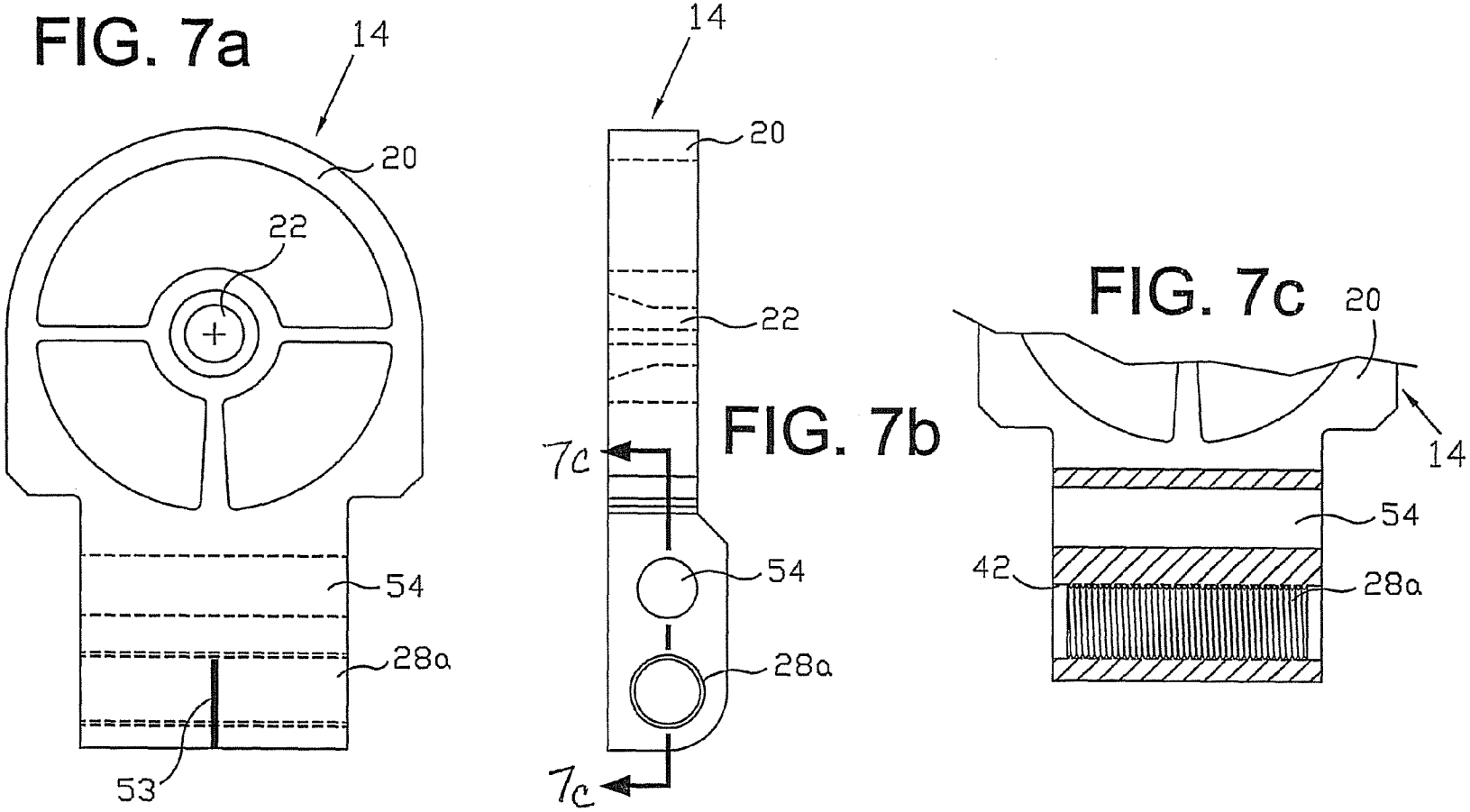
FIG. 7*a* is a front view of the aperture member of FIG. 1 showing longitudinal openings in phantom.
FIG. 7*b* is a side view of the aperture member of FIG. 7*a;*
FIG. 7*c* is a partial front view of the aperture member of FIG. 7*a* showing in cross section the longitudinal openings and taken along lines 7*c*-7*c* of FIG. 7*b;*
Figure 10:
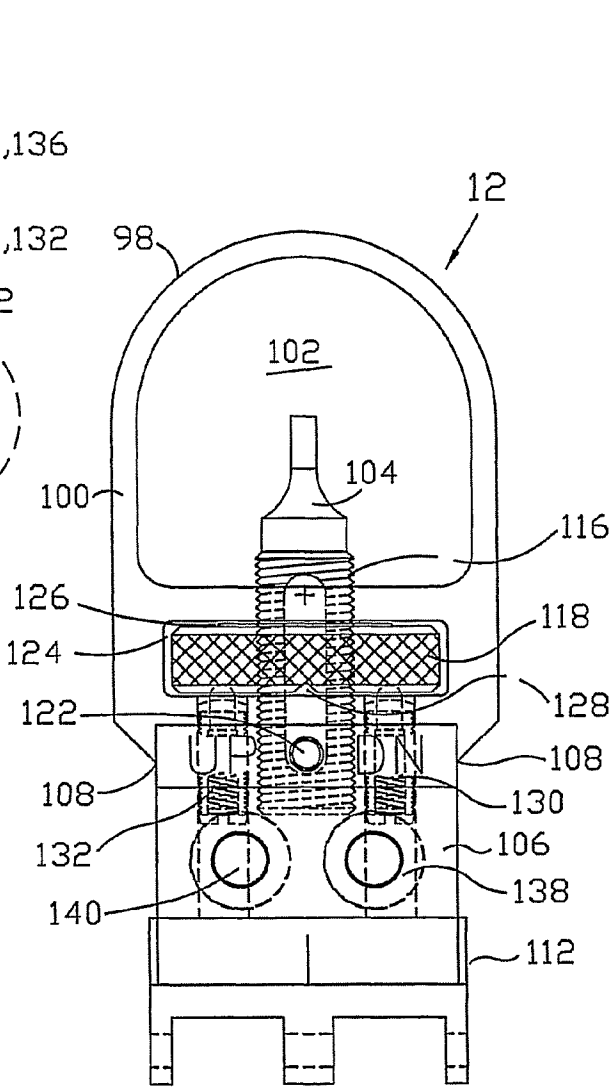
FIG. 10 is a rear view of the front sight assembly of FIG. 9.

FIG. 6*b* shows that the detent plunger spring assembly 18 may also include a sleeve assembly 78 configured to receive the two opposed plunger members 56, 58 and the spring 60. This arrangement may be used to repair or replace the detent plunger spring assembly 18, illustrated in FIG. 6*a*, particularly if the inner surface of the longitudinal opening 54 of aperture member 14 (FIGS. 7*a*-7*c*) wears after an extreme length of time and use. If a repair is needed, the sleeve assembly 78 is inserted around the plunger members 56, 58 and the spring 60. The thickness of the sleeve assembly 78 will be such as to take up any clearance existing between the inner surface of the longitudinal opening 54 and the outer surfaces of plunger members 56, 58 due to prolonged periods of wear.

FIGS. 8*a* and 8*b* illustrate a further embodiment for a detent plunger spring assembly 80 which can be used as an alternative in the L-shaped member of aperture member 14 of FIGS. 1-7*c*. This detent plunger spring assembly 80 includes a guide rod 82. Guide rod 82 has ends 84, 86 which have a reduced diameter compared to a middle portion 88 of guide rod 82. As shown in FIG. 8*a*, each end 84, 86 has a spring 90, 92, respectively, which fits into one of the two opposed plunger members 94, 96 respectively. Plunger members 94, 96 have a rounded end with a radius of about 0.25 inch.

FIGS. 9-12 illustrate the front sight assembly 12 for use with the rear sight assembly 10 of FIGS. 1-7*c*. Front sight assembly 12 includes an aperture member 98 having an upper arched portion 100 which defines a window 102 in which a sight post 104 extends upwardly. Front sight assembly 12 further includes a first base member 106 which is attached to the aperture member 98 as indicated by reference number 108 (FIGS. 9-11) and which first base member 106 has a lower dovetail surface 110 as particularly shown in FIGS. 11 and 12. Front sight assembly 12 further includes a second base member 112 or a dovetail base fixedly secured with two ⅛ inch diameter retaining pins (not shown) through the front receiving trunnion on top of the machine gun MG as illustrated in FIGS. 31 and 32. Still referring to FIGS. 11 and 12, second base member 112 has a dovetail upper surface 114 that corresponds to that of and is slidable within the dovetail surface 110 of the first base member 106 for the lateral movement of the aperture member 98 and the first base member 106 relative to the longitudinal plane of the machine gun MG (FIGS. 31 and 32). It is to be appreciated that the second base member 112 is fixedly secured via retaining pins to the front receiving trunnion located on top of the machine gun in a manner well known to those skilled in the art.

Figure 9:
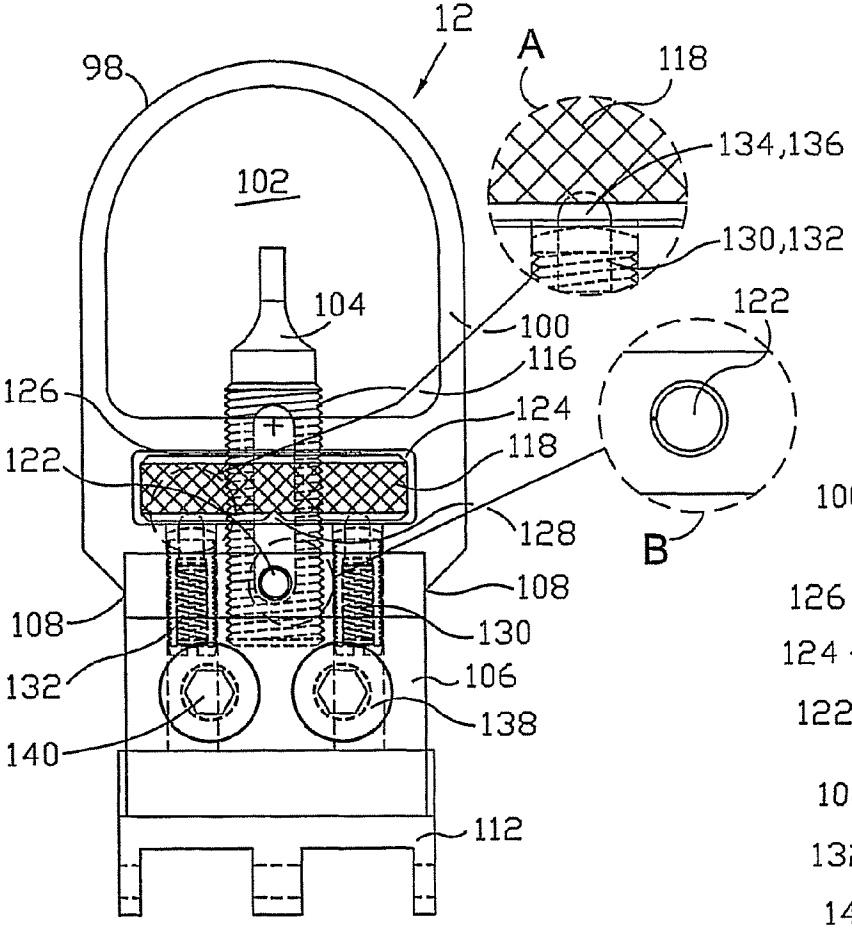
FIG. 9 is a front view of a front sight assembly for use with the rear sight assembly of FIG. 1 and showing in phantom its internal structure and containing enlarged views A and B.
Figure 12:
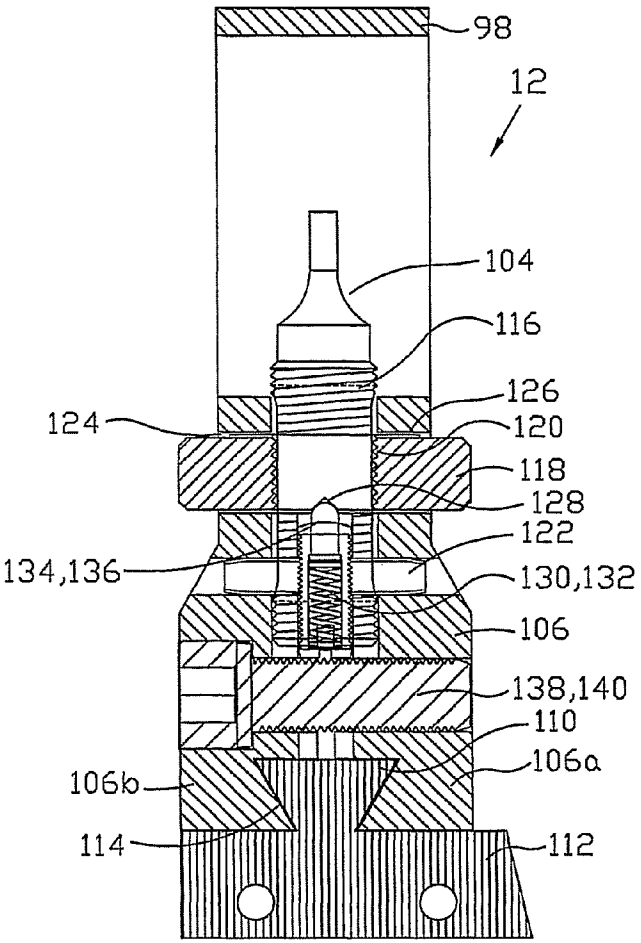
FIG. 12 is a cross-sectional side view of the front sight assembly of FIG. 11.
Figure 11:
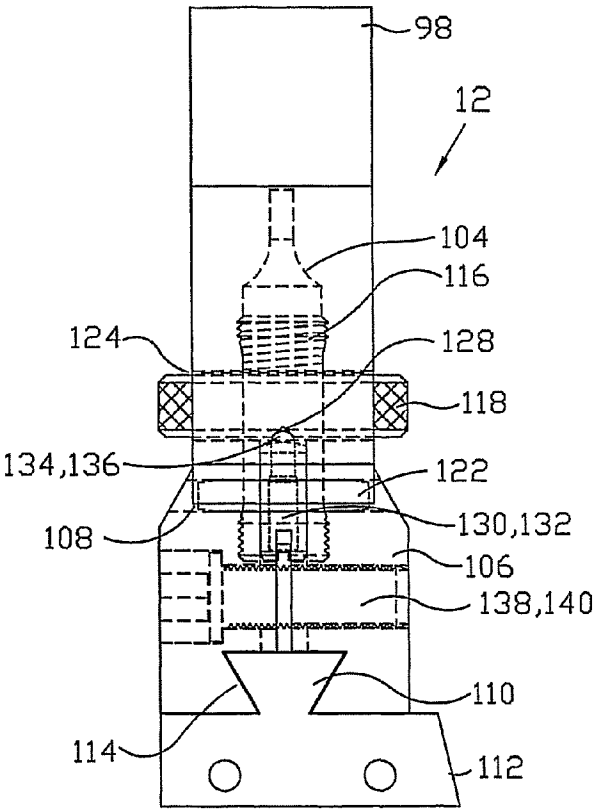
FIG. 11 is a side view of the front sight assembly of FIG. 9.

Still referring to FIGS. 9 and 12, the sight post 104 has an external threaded portion 116 which extends through aperture member 98, through an elevation knob 118 and into first base member 106. Elevation knob 118 has an internal threaded portion 120 (FIG. 12) which engages the external threaded portion 116 of the sight post 104 for raising and lowering the sight post 104 within the window 102 of the aperture member 98 upon rotation of the elevation knob 118. As sight post 104 travels in an upward direction and in a downward direction for its lowering within window 102, it is guided by a pin retainer 122, as shown best in FIG. 12.

Still referring to FIGS. 9 and 12, elevation knob 118 is located within an opening 124 in aperture member 98. Elevation knob 118 has an upper shim-like surface 126 for abutting tightly against the upper surface of opening 124 and a lower surface having several notches or recesses, one shown at 128 in FIGS. 9-12. Located diametrically opposite the threaded portion 120 of sight post 104 are detent spring loaded plunger assemblies 130, 132 wherein plungers 134, 136 of each assembly 130, 132 engage in and are retained in one of the recesses 128 of elevation knob 118 upon rotation of the elevation knob 118 in the raising and lowering of sight post 104 in window 102. This system, i.e., the two detent spring loaded plunger assemblies 130, 132 and the engagement of their plungers 134, 136 within the inverted V-shaped recesses 128 of the elevation knob 118 assures that sight post 104 remains in its desired position during operation of the machine gun MG.

As shown particularly in FIG. 12, the first base member 106 includes two sections 106*a*, 106*b* which are connected together via cap screws 138, 140. Adjustment of the tensioning of the dovetail surface 110 of base member 106 against the dovetail surface 114 of the second base member 112 is achieved through tightening or loosening of the two cap screws 138, 140 to either separate or bring the two sections 106*a*, 106*b* of first base member 106 together.

FIGS. 13*a*-30*b* pertains to a second embodiment of a sighting system of the invention, which generally may be found on an M3 flexible 50 caliber machine gun. FIGS. 13*a*-18*b* pertains to a fixed rear sight assembly 142 which generally does not provide for windage lateral movement or adjustment of an aperture. FIGS. 19-24*b* pertain to a rear sight assembly 144 which does include an adjustment mechanism for windage lateral movement of an aperture. FIGS. 25-30*a* pertain to a front sight assembly 146 which may be used either with the fixed rear sight assembly 142 of FIGS. 13-17 or with the rear sight assembly 144 of FIGS. 19-23 and can be mounted on the top rear section of the receiver R supporting the machine gun MG as illustrated with respect to the first embodiment shown in FIGS. 36 and 37.

Figure 13A:
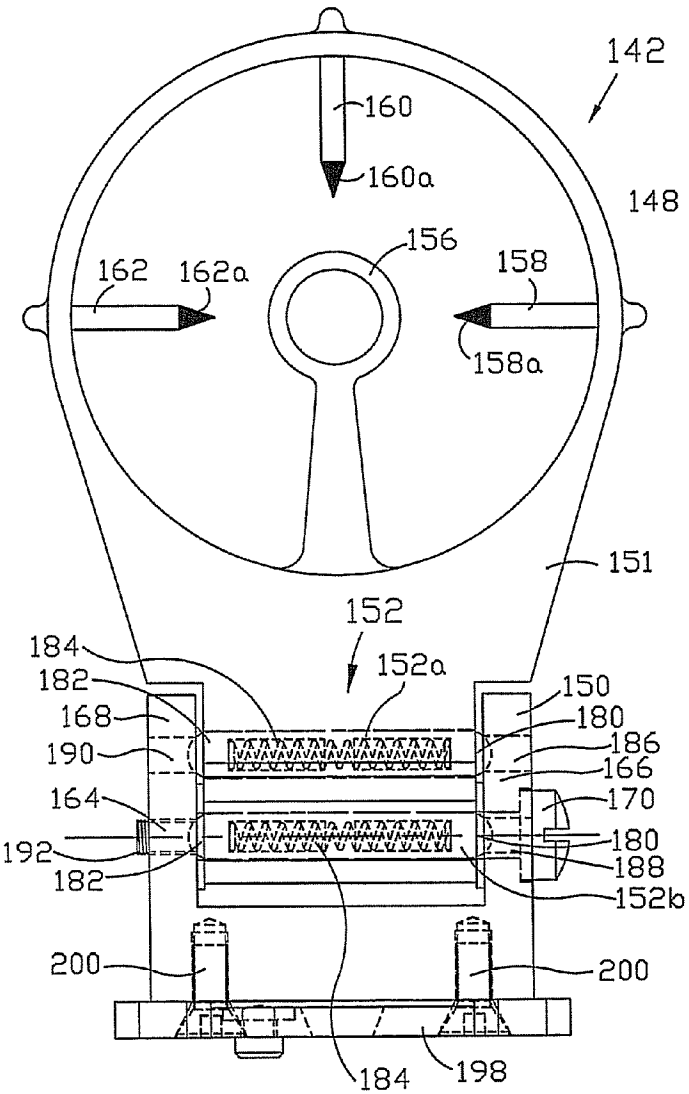
FIG. 13*a* is a rear view of a fixed rear sight assembly of a second embodiment of the invention and showing in phantom the internal structure and some components of the rear sight assembly.
Figure 13B:
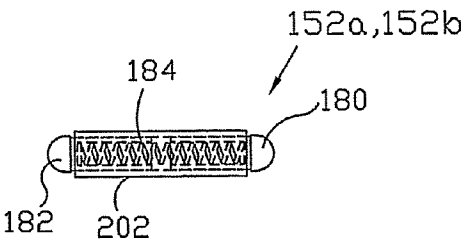
FIG. 13*b* is a front view of a detent plunger spring assembly for use in the fixed rear sight assembly of FIG. 13*a* which may be used to repair the detent plunger spring assemblies of FIG. 13*a;*
Figure 14:
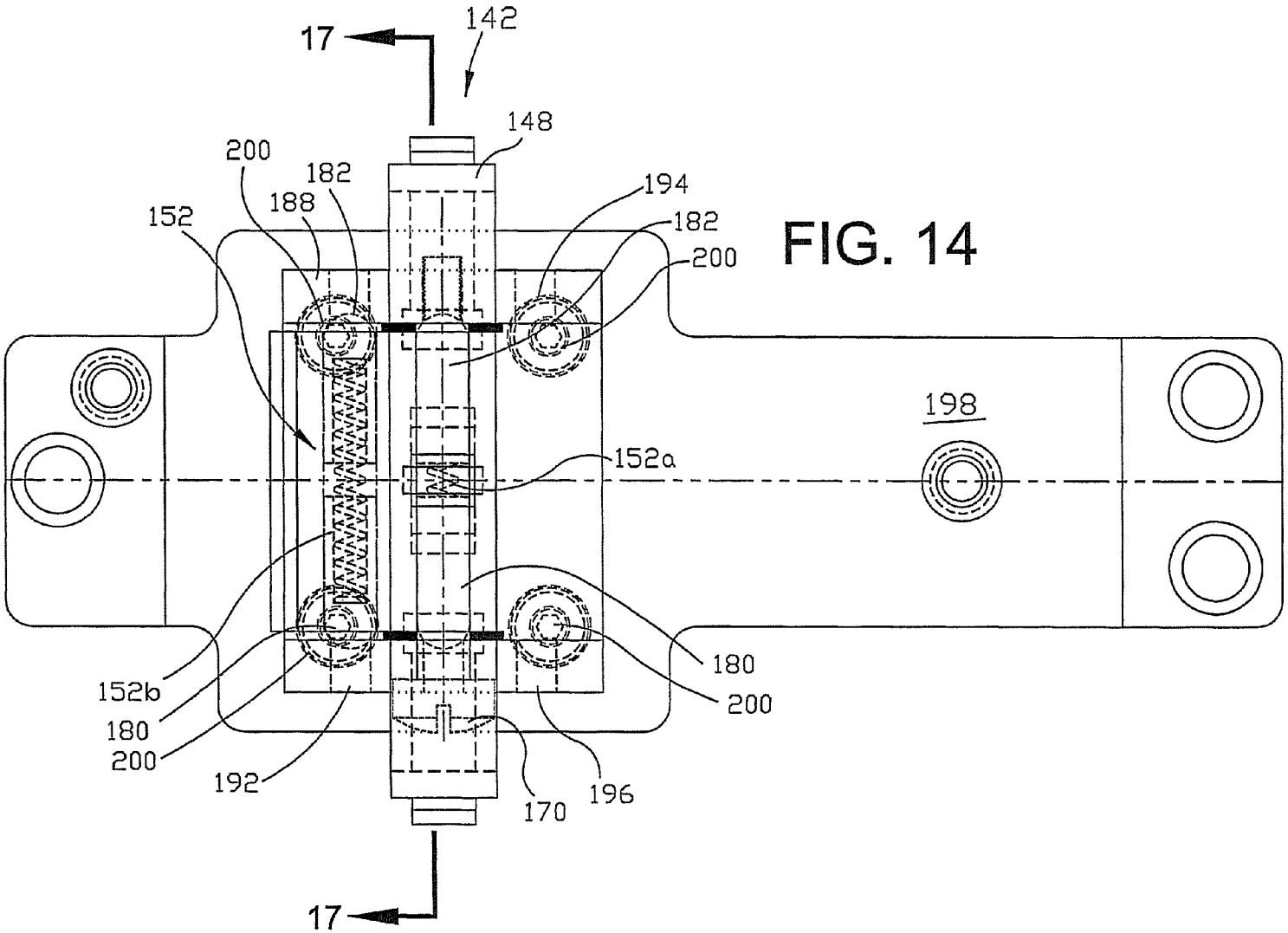
FIG. 14 is a top view of the rear sight assembly of FIG. 13*a* and showing in phantom the internal structure and some components of the rear sight assembly.
Figures 15, 16:
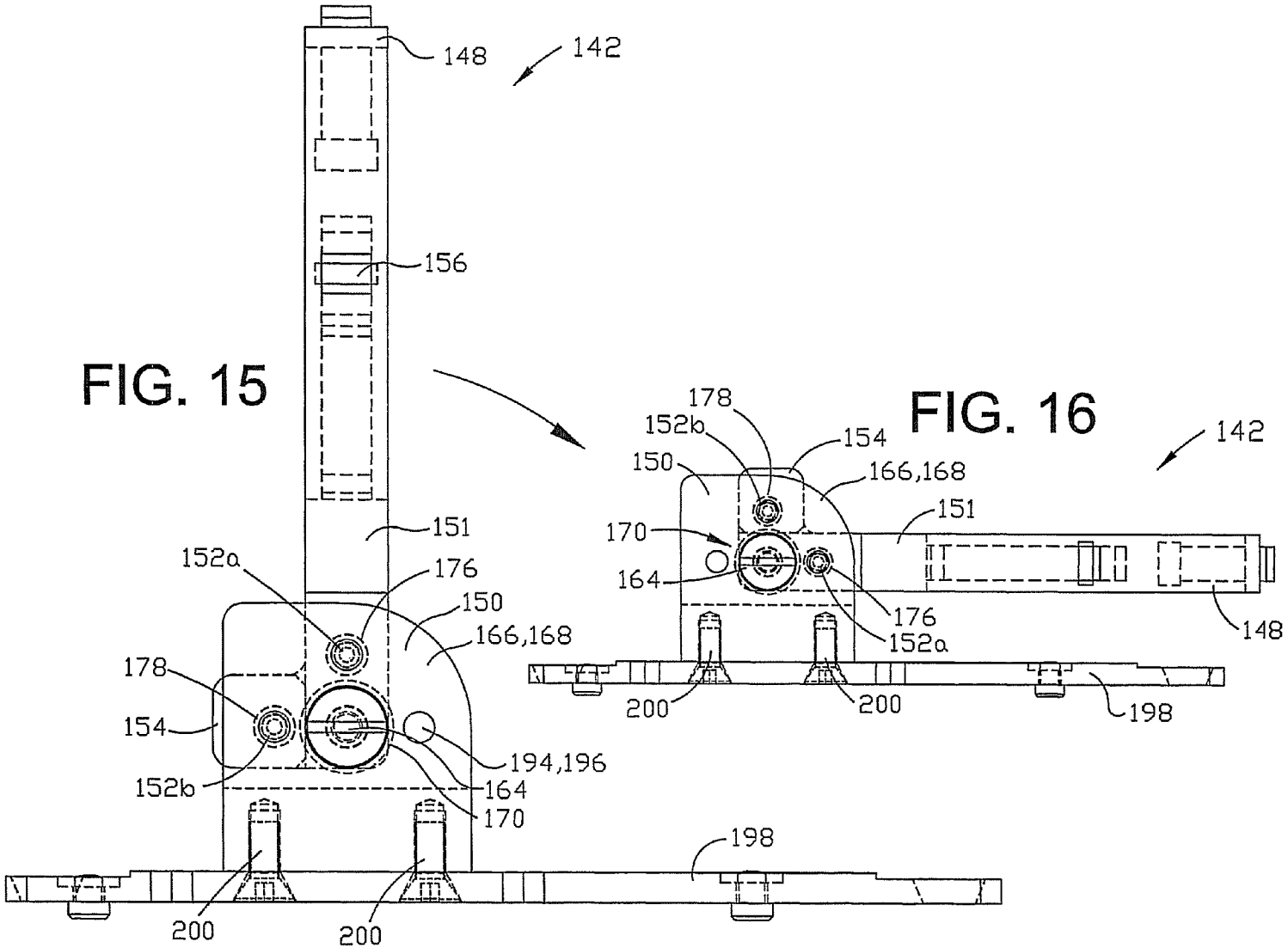
FIG. 15 is a right-side view of the rear sight assembly of FIG. 13*a* showing an L-shaped pivotal member of an aperture member in its positioning of FIGS. 13*a* and 14.
FIG. 16 is a smaller scale right-side view of the rear sight assembly showing the L-shaped pivotal member of the aperture member of FIG. 15 and its positioning when pivoted 90 degrees to the right as indicated by the arrow in FIG. 15.

The fixed rear sight assembly 142 of FIGS. 13*a*-17 include an aperture member 148, a base support cradle 150 for supporting the aperture member 148, and a detent plunger spring arrangement 152 (FIG. 13*a*) which is operatively connected to the aperture member 148 for registering and retaining aperture member 148 in a fixed position within the base support cradle 150 and relative to a line-of-sight while the machine gun is being operated. As particularly shown in FIGS. 15 and 16, the aperture member 148 is an L-shaped pivotal member having a first leg 151 and a second leg 154, and as particularly shown in FIGS. 13*a*, 15 and 17, the first leg 151 has a fixed center aperture 156. As shown in FIGS. 15 and 16, the second leg 154 is relatively shorter than that of first leg 151 and does not have an aperture. Still referring to FIGS. 15 and 17, aperture member 148 also includes radial elements 158, 160 and 162, each having a pointed end 158*a*, 160*a*, and 162*a*, respectively, pointing toward aperture 156.

Referring to FIGS. 13*a* and 14-17, aperture member 148 is pivotally mounted in base support cradle 150 via an elongated shaft 164 which extends through support members 166, 168 (FIGS. 13*a* and 17) of the base support cradle 150. As particularly shown in FIGS. 13*a* and 17, the elongated shaft 164 is a part of a retaining screw assembly 170 which retains and prevents movement of aperture member 148 within base support cradle 150. As shown best in FIG. 17, elongated shaft 164 has a threaded end portion 164*a* which extends into and engages with a threaded portion 168*a* of support member 168 of the base support cradle 150, and bushing spacers 172, 174 are mounted onto elongated shaft 164 to space and then retain aperture member 148 in position relative to the inner surfaces of support members 166, 168 of base support cradle 150.

As best shown in FIG. 13*a*, the detent plunger spring assembly 152 includes a first detent plunger spring assembly 152*a* and a second detent plunger spring assembly 152*b*. Aperture member 148 further includes a longitudinal opening 176 in first leg member 151 and a longitudinal opening 178 in second leg member 154 for receiving the detent plunger spring assemblies 152*a*, 152*b*, respectively, of the fixed rear sighting assembly 142. Detent plunger spring assemblies 152*a*, 152*b* are operatively connected to aperture member 148.

Figure 17:
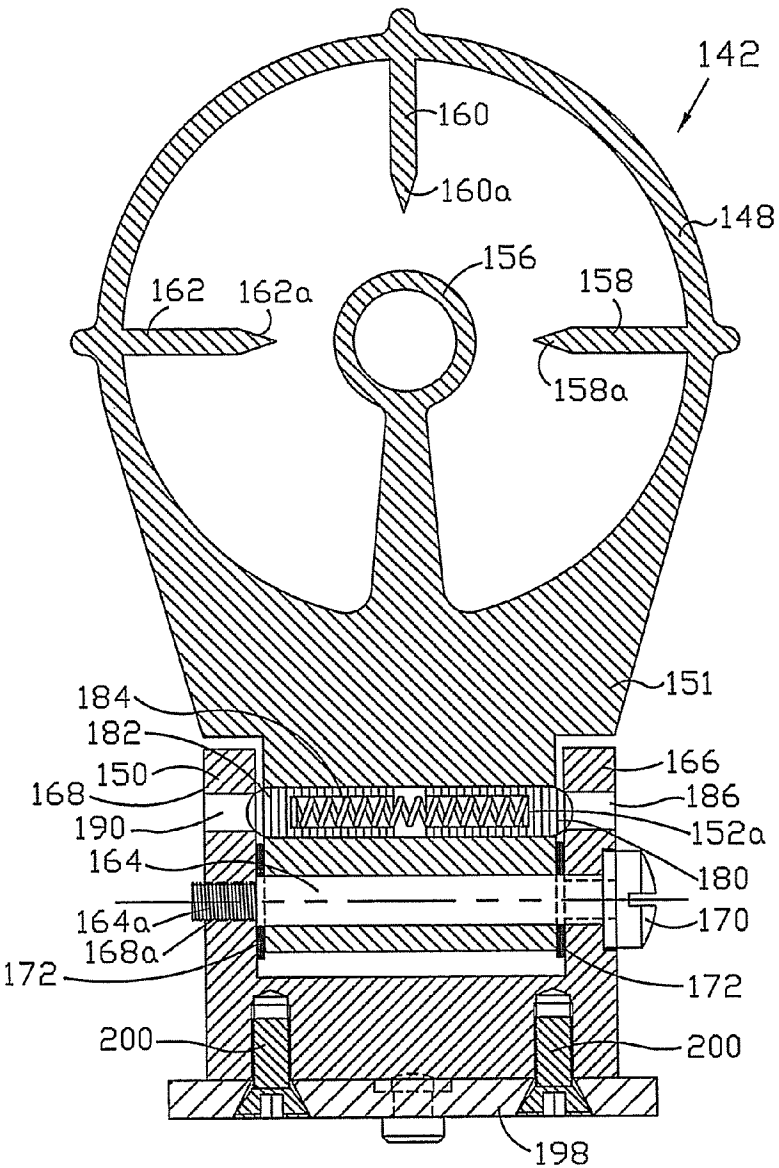
FIG. 17 is a cross-sectional view of the rear sight assembly taken along lines 17-17 of FIG. 14.

As best shown in FIG. 13*a*, the detent plunger spring assemblies 152*a*, 152*b* have two opposed plunger members 180, 182 and a spring 184 which extends between and into the two plunger members 180, 182. As best shown in FIGS. 13*a* and 17 plunger member 180 of detent plunger spring assembly 152*a* is received in an opening 186 and plunger member 180 of detent plunger spring assembly 152*b* is received in an opening 188 of support member 166. Plunger member 182 of detent plunger spring assembly 152*a* is received in an opening 190 and plunger member 182 of detent plunger spring assembly 152*b* is received in an opening 192 of support member 168 of the base support cradle 150 when aperture member 148 is in its position illustrated in FIGS. 13*a*, 14, 15 and 17. However, when aperture member 148 is pivoted 90 degrees as illustrated in FIG. 16, plunger member 180 of detent plunger spring assembly 152*a* is received in an opening 194 (shown best in FIGS. 14 and 15) of support member 166, and the plunger member 182 of detent plunger spring assembly 152*a* is received in an opening 196 (shown best in FIGS. 14 and 15) of support member 168; whereas plunger members 180, 182 of detent plunger spring assembly 152*b* are received in openings 186, 190 of support members 166 and 168, respectively.

As will be appreciated, detent plunger spring assemblies 152*a*, 152*b* are constructed and operate similarly to the detent plunger spring assembly 18 of FIGS. 1-6*a*. Pivotal movement of aperture member 148 is generally done manually and is generally pivoted in the position of FIG. 16 for stowing purposes. The two detent plunger spring assemblies 152*a*, 152*b* securely retain and maintain aperture member 148 in an operative position illustrated in FIGS. 13*a*, 14, 15 and 17 and in an inoperative, stowing position illustrated in FIG. 16.

As best shown in FIG. 14, base support cradle 150 is mounted to a base plate 198 via a plurality of retaining screws 200, four of which are shown in FIG. 14;

FIG. 13*b* shows that the detent plunger spring assemblies 152*a*, 152*b* may also include a sleeve assembly 202 configured to receive the two opposed plunger members 180, 182 and spring 184. This arrangement may be used to repair or replace the detent plunger spring assemblies 152*a*, 152*b* of the embodiment of FIGS. 13*a* and 14-17, particularly if the inner surface of the longitudinal openings 176, 178 of aperture member 148 (FIGS. 15 and 16) wears after excessive use. If a repair is needed, sleeve assembly 202 may be inserted around plunger members 180, 182 and spring 184 of each detent plunger spring assembly 152*a*, 152*b*. The thickness of sleeve assembly 202 will be such as to take up any clearance existing between the inner surface of the longitudinal openings 176, 178 and the outer surfaces of plunger members 180, 182 due to excessive use.

Figure 18B:
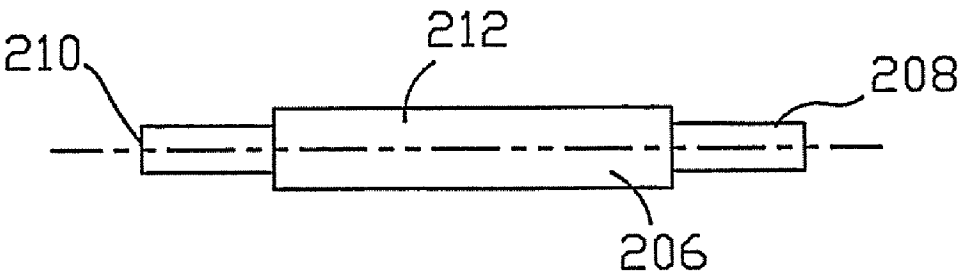
FIG. 18*b* is a front view of a guide rod of the detent plunger spring assembly of FIG. 18*a;*
Figure 18A:
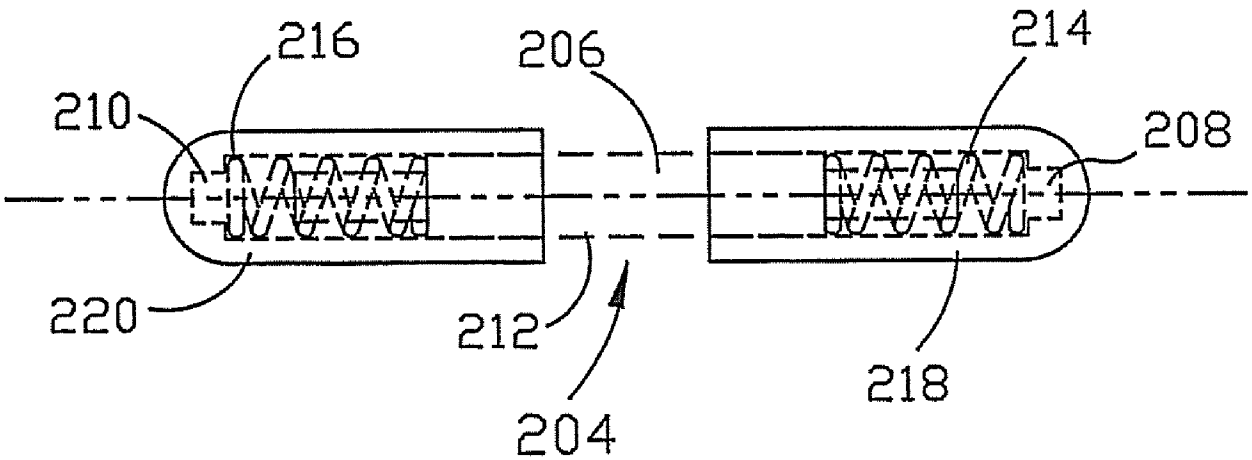
FIG. 18*a* is a front view of a detent plunger spring assembly which may be used as an alternate or replacement for the detent plunger spring assemblies for the aperture member of FIG. 13*a* and showing in phantom its components.

FIGS. 18*a* and 18*b* illustrate a further embodiment of a detent plunger spring assembly 204 which can also be used in aperture member 148 as an alternative for the detent plunger spring assemblies 152*a*, 152*b* of FIG. 13*b*. Assembly 204 includes a guide rod 206 having ends 208, 210 with a reduced diameter compared to a middle portion 212. As shown in FIG. 18*a*, each end 208, 210 has a spring 214, 216, respectively, which fits into one of the two opposed plunger members 218, 220, respectively. Plunger members 218, 220 have a rounded end with a radius of about 0.25 inch.

As stated hereinabove, FIGS. 19*a*-24*b* pertain to a movable rear sight assembly 144 (FIGS. 19*a* and 20-23) which can be used as an alternative to the fixed rear sight assembly of FIGS. 13*a*-18*b* in the second embodiment of the sighting system of the invention.

Figure 19A:
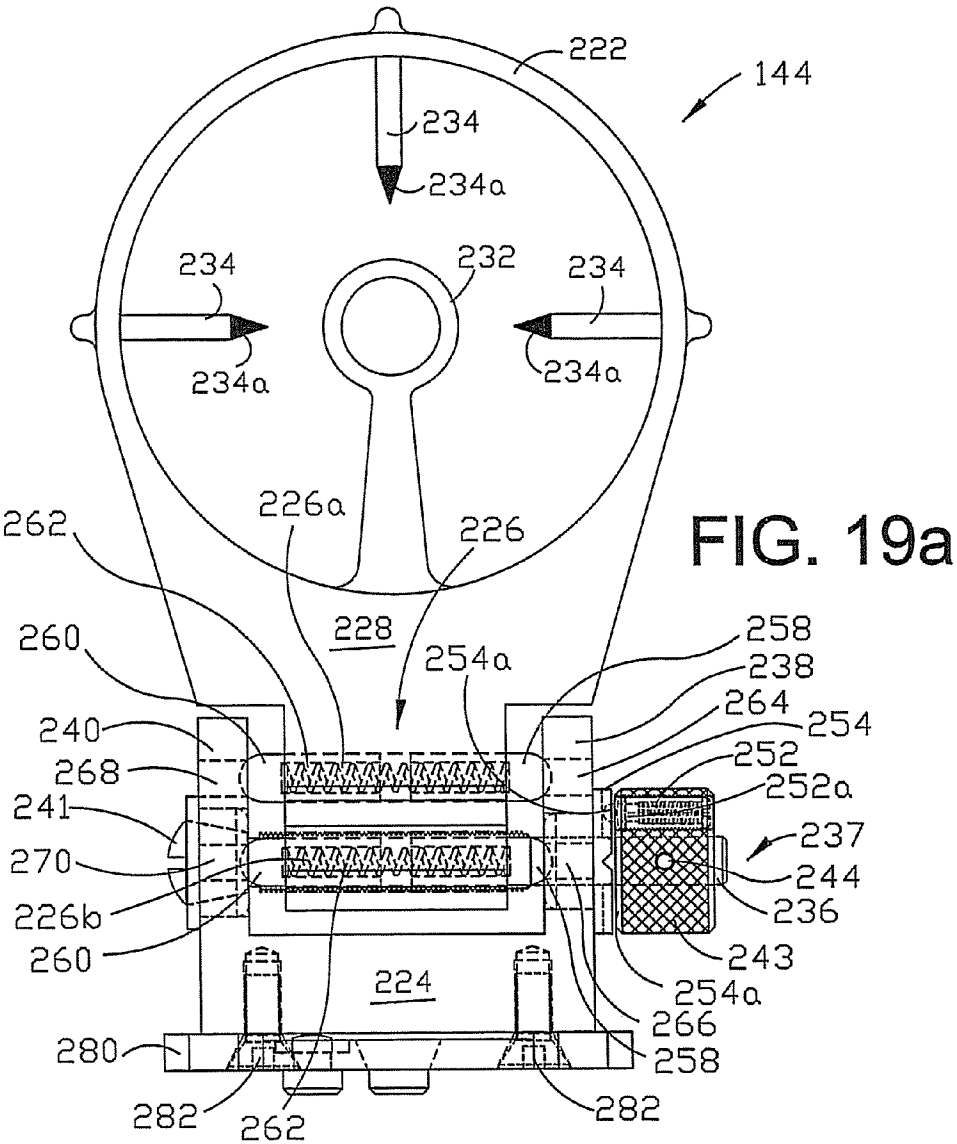
FIG. 19*a* is a rear view of a movable rear sight assembly of a second embodiment of the invention and showing in phantom the internal structure and some components of the rear sight assembly.
Figures 21, 22:
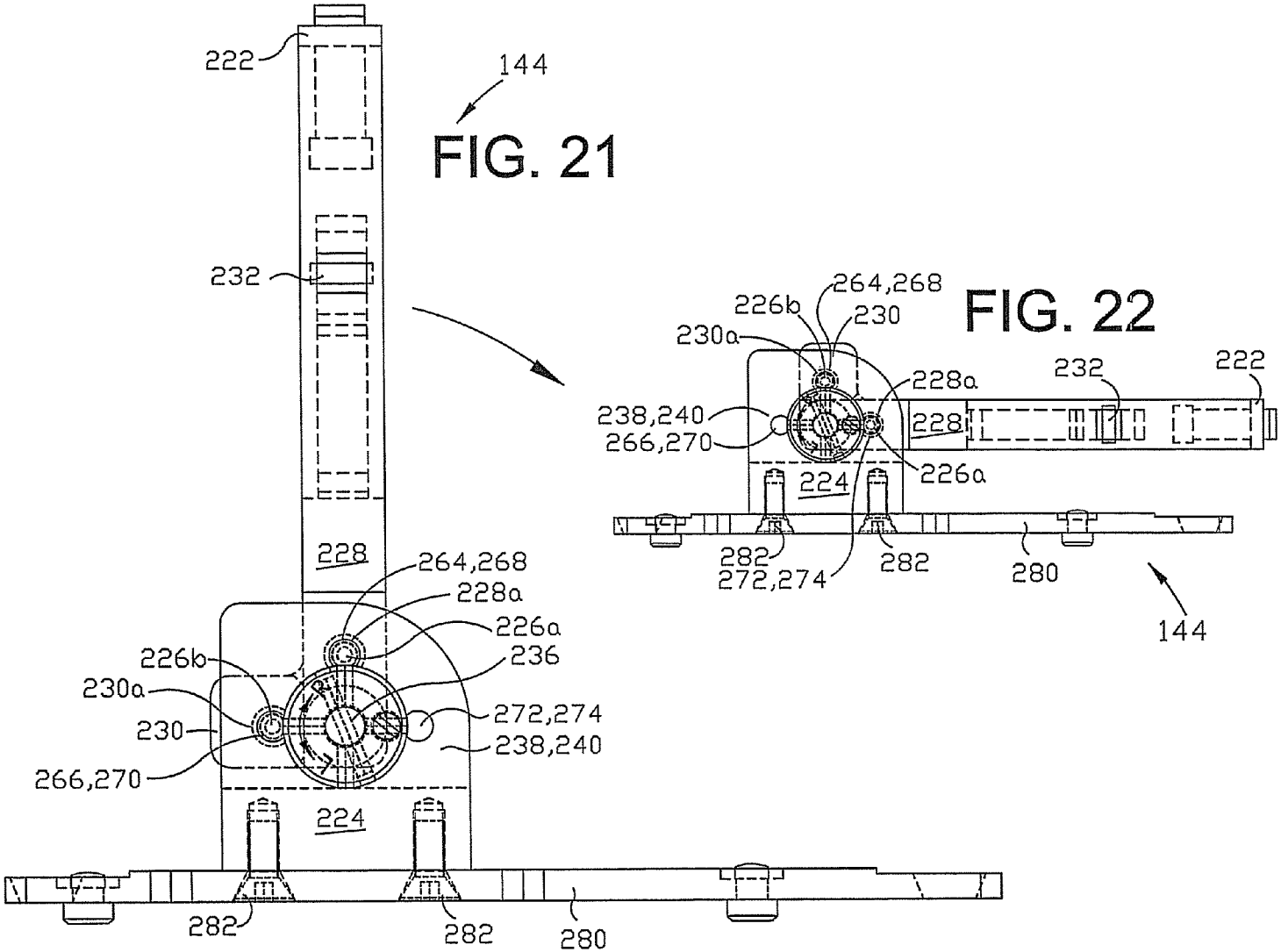
FIG. 21 is a smaller scale right-side view of the movable rear sight assembly of FIG. 19*a* and showing an L-shaped pivotal member of an aperture member in its positioning of FIGS. 19*a* and 20.
FIG. 22 is a right-side view of the movable rear sight assembly of FIG. 19*a* and showing the L-shaped pivotal member pivoted 90 degrees to the right as shown in FIG. 21.
Figure 23:
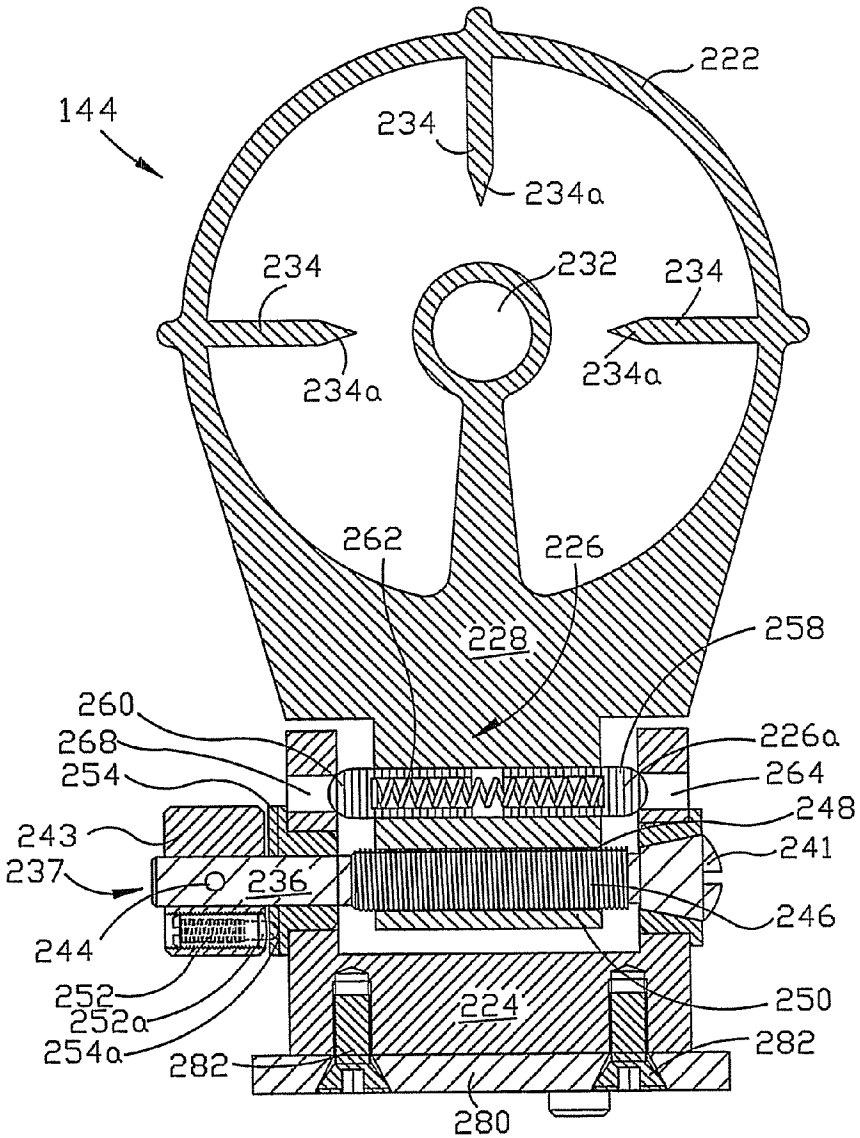
FIG. 23 is a cross-sectional view of the L-shaped pivotal member of an aperture member taken along lines 23-23 of FIG. 20.

As shown in FIGS. 19*a* and 23, the movable rear sight assembly 144 includes an aperture member 222, a base support cradle 224 for supporting the aperture member 222 and a detent plunger spring arrangement 226 which is operatively connected to the aperture member 222 for registering and retaining aperture member 222 in a fixed position within base support cradle 224 and relative to a line-of-sight when machine gun MG is operated. As particularly shown in FIGS. 21 and 22, aperture member 222 is an L-shaped pivotal member having a first leg 228 and a second leg 230, and as particularly shown in FIGS. 19*a* and 23, first leg 228 has a fixed center aperture 232. As shown in FIGS. 21 and 22, the second leg 230 is relatively shorter than that of first leg 228 and does not have an aperture. Still referring to FIGS. 19*a* and 23, aperture member 222 also includes radial elements 234, each having a pointed end 234*a* that points inwardly toward the fixed center aperture 232.

Referring particularly to FIGS. 19*a*, 21, 22 and 23, aperture member 222 is pivotally mounted in base support cradle 224 via an elongated shaft 236 which extends through support members 238, 240 (FIGS. 19*a* and 23) of base support cradle 224. As shown in FIGS. 19*a* and 23, the elongated shaft 236 is a part of a retaining screw assembly.

Elongated shaft 236 extends outwardly from the support member 238 as shown to the right of FIG. 19*a* and to the left of FIG. 23 and extends through a knurled knob 243, which, in turn, is secured to the end of shaft 236 via a retaining roll pin 244. Shaft 236 has a threaded external portion indicated at 246 in FIG. 23 which extends longitudinally through the aperture member 222 via a longitudinal opening 248, which is shown best in FIG. 23, and which engages with internal threads therein as shown at 250 in FIG. 23. Knob 243 is rotatable and is used to rotate the elongated shaft 236 and its threaded portion 246 for the lateral windage movement of aperture member 222 along the threaded portion 246 of elongated shaft 236 and within base support cradle 224.

Figure 20:
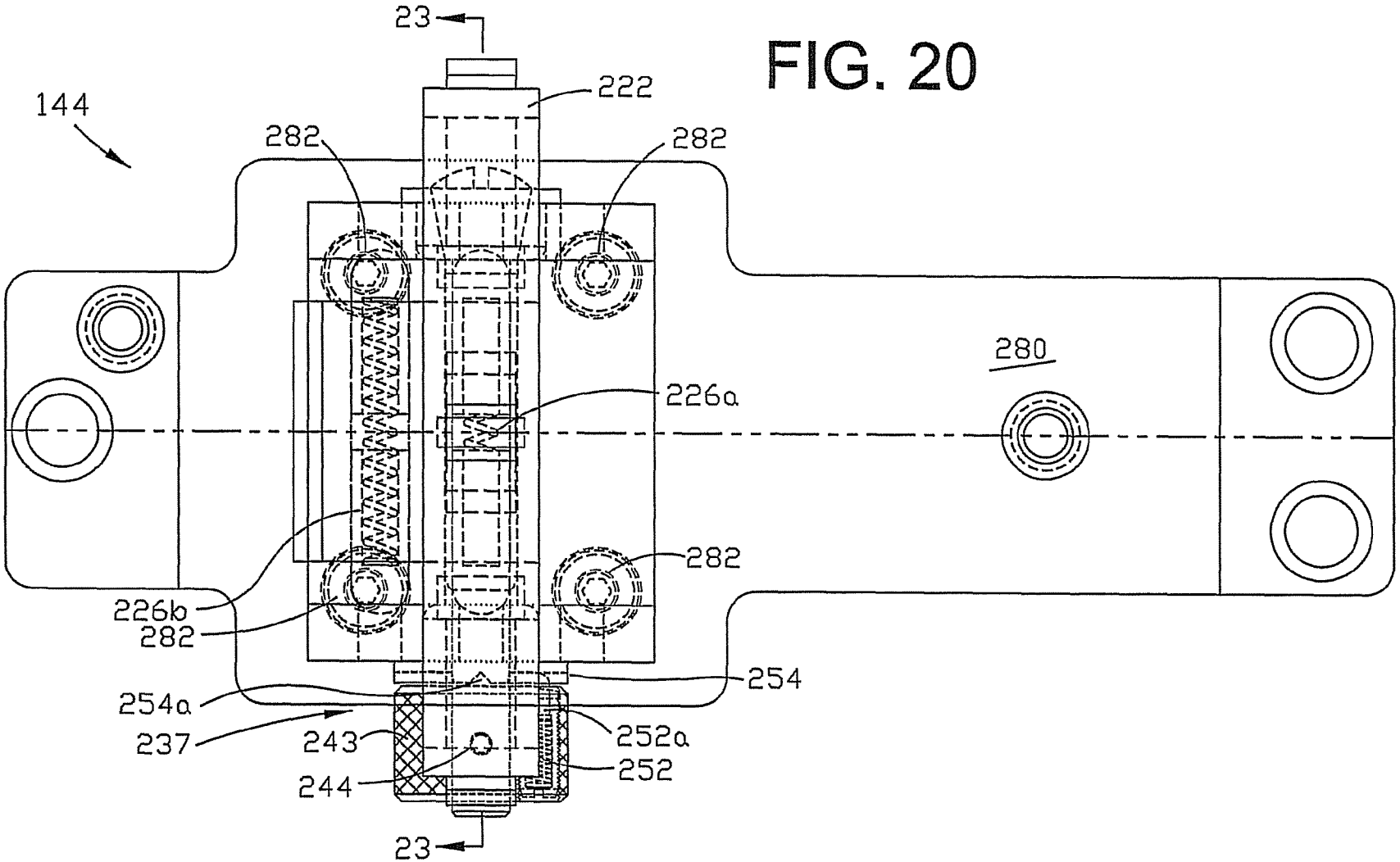
FIG. 20 is a top view of the movable rear sight assembly of FIG. 19*a;*

Referring particularly to FIGS. 19*a*, 20 and 23, windage screw assembly 237 further includes a detent screw/plunger assembly 252, which is located in knob 243, and a bushing member 254. Bushing member 254 has a plurality of recesses, one indicated at number 254*a* for receiving and retaining a plunger 252*a* of the detent screw/plunger assembly 252 for preventing rotation of the knob 243 and the elongated shaft 236 of windage screw assembly 237. As shown particularly to the left of FIG. 19*a* and to the right of FIG. 23, the retaining screw assembly includes a screw head 241 located on the elongated shaft 236 opposite knob 243. The retaining screw head 241 holds the windage screw assembly 237 and gives a stronger lock-up of the components of the windage screw assembly 237. The total lateral windage movement of the aperture member 222 along the threaded portion 246 of the elongated shaft 236 is about ⅜ of an inch in both directions, i.e., about 3/16 inch to the right and about 3/16 inch to the left of FIGS. 19*a* and 23.

As best shown in FIG. 19*a*, the detent plunger spring arrangement 226 includes a first detent plunger spring assembly 226*a* and a second detent plunger spring assembly 226*b*. As shown in FIGS. 21 and 22, aperture member 222 further includes a longitudinal opening 228*a* in first leg member 228 and a longitudinal opening 230*a* in second leg member 230 for receiving the detent plunger spring assemblies 226*a*, 226*b*, respectively, of the rear sight assembly 144. Detent plunger spring assemblies 226*a*, 226*b* are operatively connected to the aperture member 222.

As best shown in FIGS. 19*a* and 23, detent plunger spring assemblies 226*a*, 226*b* have two opposed plunger members 258, 260 and a spring 262 which extends between and into the plunger members 258 and 260. As best shown in FIGS. 19*a* and 23, plunger member 258 of detent plunger spring assembly 226*a* is received in an opening 264 and plunger member 258 of detent plunger spring assembly 226*b* is received in an opening 266 of support member 238. Plunger member 260 of detent plunger spring assembly 226*a* is received in an opening 268 and plunger member 260 of detent plunger spring assembly 226*b* is received in an opening 270 of support member 240 of the base support cradle 224 when aperture member 222 is in its position illustrated in FIGS. 19*a*, 20, 21 and 23. However, when aperture member 222 is pivoted 90 degrees, as illustrated in FIG. 22, the plunger members 258, 260 of detent plunger spring assembly 226*a* are received in openings 272, 274 of support members 238, 240, respectively (FIGS. 21 and 22), and the plunger members 258, 260 of detent plunger spring assembly 226*b* are received in openings 264, 268 of support members 238, 240, respectively.

As will be appreciated, detent plunger spring assemblies 226*a*, 226*b* are constructed and operate similarly to detent plunger spring assembly 18 of the embodiment of FIGS. 1-6*a*. Pivotal movement of aperture member 222 is generally done manually and is generally pivoted in the position of FIG. 22 for stowing purposes. The two detent plunger spring assemblies 226*a*, 226*b* securely retain and maintain aperture member 222 in an operative position illustrated in FIGS. 19*a*, 20 and 21 and in an inoperative, stowing position illustrated in FIG. 22.

As best shown in FIGS. 19*a* and 20-23, base support cradle 224 is mounted to a base plate 280 via a plurality of retaining screws 282, four of which are shown in FIG. 20.

Figure 19B:
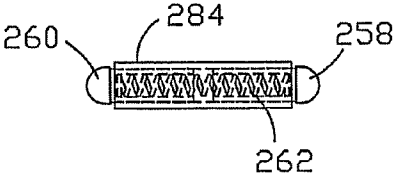
FIG. 19*b* is a front view of a detent plunger spring assembly for use in the movable rear sight assembly of FIG. 19*a* which may be used to repair the detent plunger spring assemblies in FIG. 19*a;*

FIG. 19*b* shows that detent plunger spring assemblies 226*a* and 226*b* may also include a sleeve assembly 284 configured to receive the two opposed plunger members 258, 260 and spring 262. This arrangement may be used to repair or replace the detent plunger spring assemblies 226*a*, 226*b* illustrated in the embodiment of FIGS. 19*a* and 20-23, particularly if the inner surface of the longitudinal openings 228*a*, 230*a* of aperture member 222 (FIGS. 21 and 22) wears after excessive use. If a repair is needed, sleeve assembly 284 is inserted around plunger members 258, 260 and spring 262. The thickness of sleeve assembly 284 will be such as to take up any clearance existing between the inner surface of longitudinal openings 228*a*, 230*a* and the outer surfaces of plunger members 258, 260 due to excessive wear.

Figure 24A:
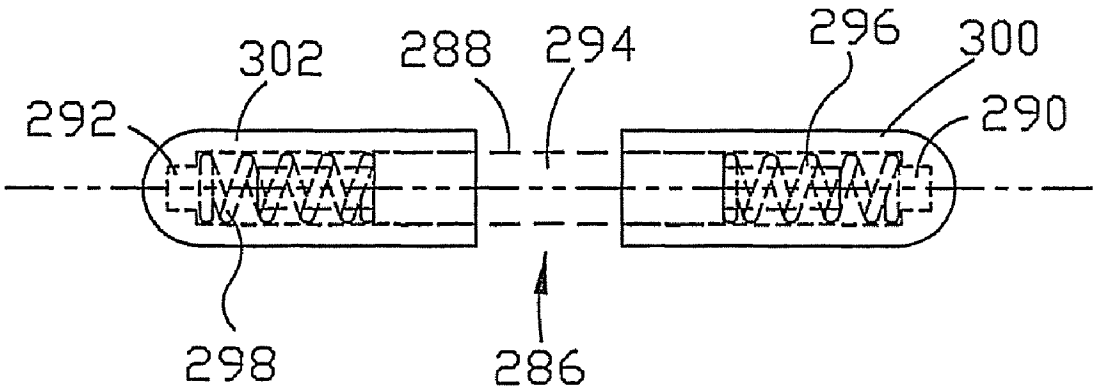
FIG. 24*a* is a front view of a detent plunger spring assembly which may be used as an alternate or replacement for the detent plunger spring assemblies for the aperture member of FIG. 19*a* and showing in phantom its components.
Figure 24B:
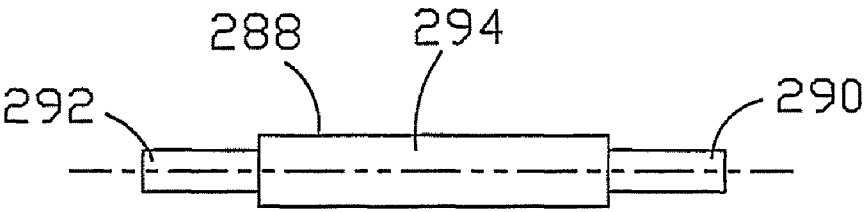
FIG. 24*b* is a front view of a guide rod of the detent plunger spring assembly of FIG. 24*a;*

FIGS. 24*a* and 24*b* illustrate a further embodiment for a detent plunger spring assembly 286 which can also be used in aperture member 222 as a replacement for detent plunger spring assemblies 226*a*, 226*b* of FIGS. 19*a*-23. Detent plunger spring assembly 286 includes a guide rod 288 having ends 290, 292 with a reduced diameter compared to a middle portion 294. As shown in FIG. 24*a*, each end 290, 292 has a spring 296, 298, respectively, which fits into one of the two opposed plunger members 300, 302, respectively. Plunger member 300, 302 have a rounded end with a radius of about 0.25 inch.

Figure 25:
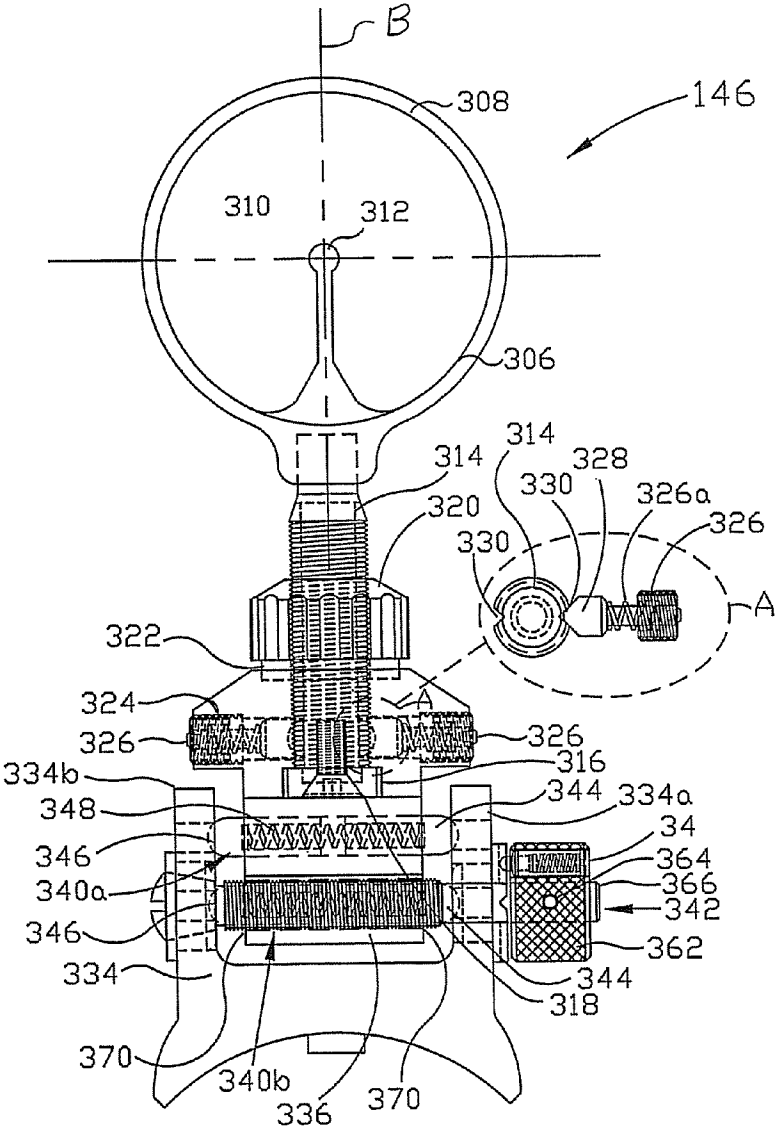
FIG. 25 is a rear view of a front sight assembly for use with the rear sight assembly of FIG. 13*a* and FIG. 19*a* and showing in phantom its internal structure and some of its components and containing an enlarged view A.
Figure 26:
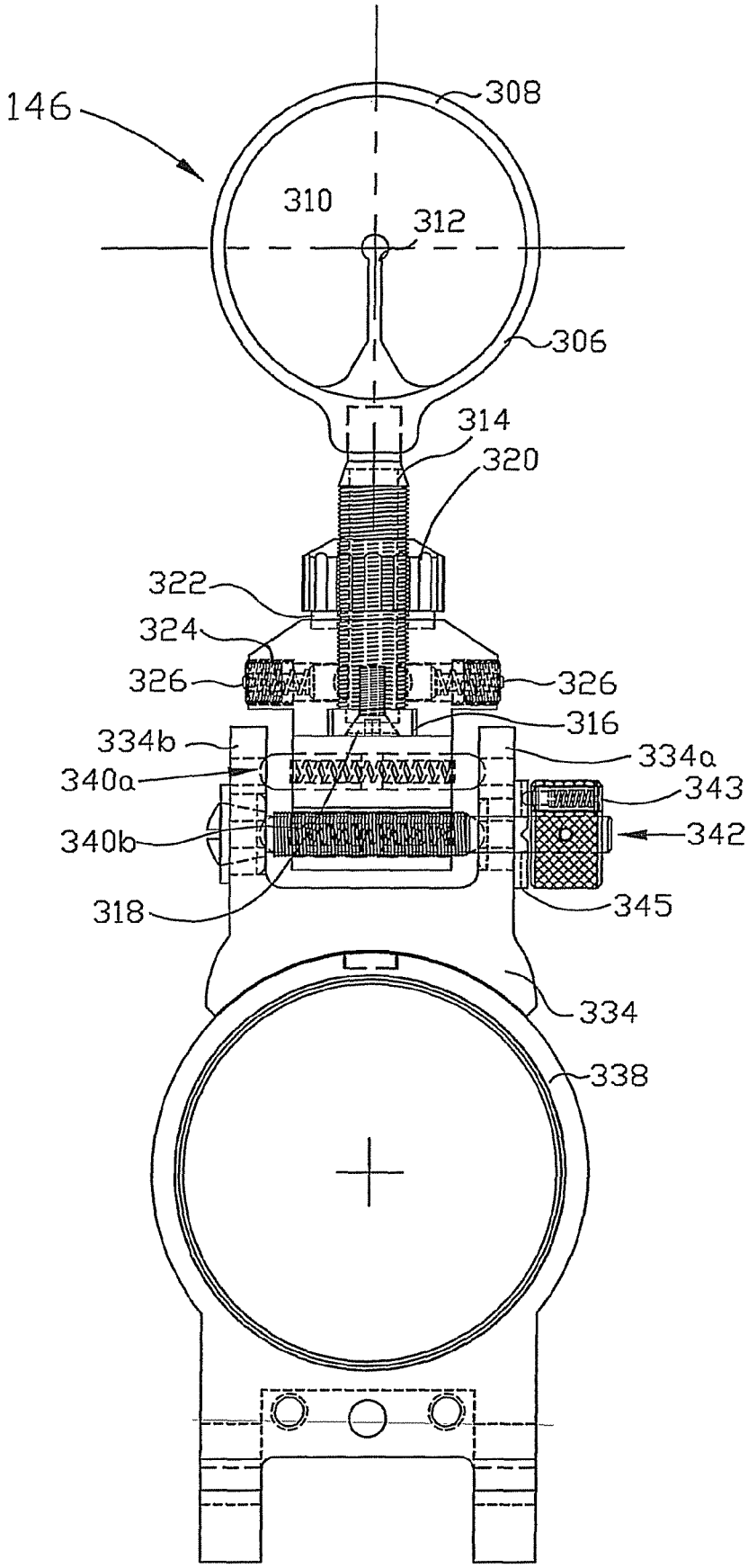
FIG. 26 is a full rear view of the front sight assembly of FIG. 25 and includes a trunnion adapter for attaching the front sight assembly to a receiver of a machine gun.
Figure 27:
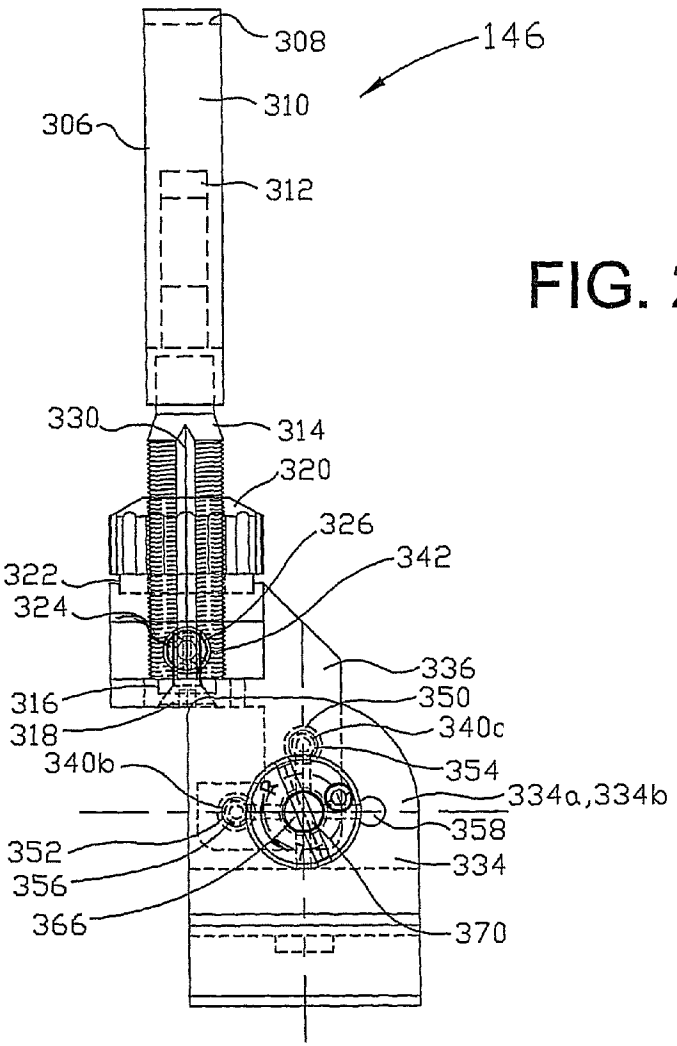
FIG. 27 is a right-side view of the front sight assembly of FIG. 25.
Figure 29:
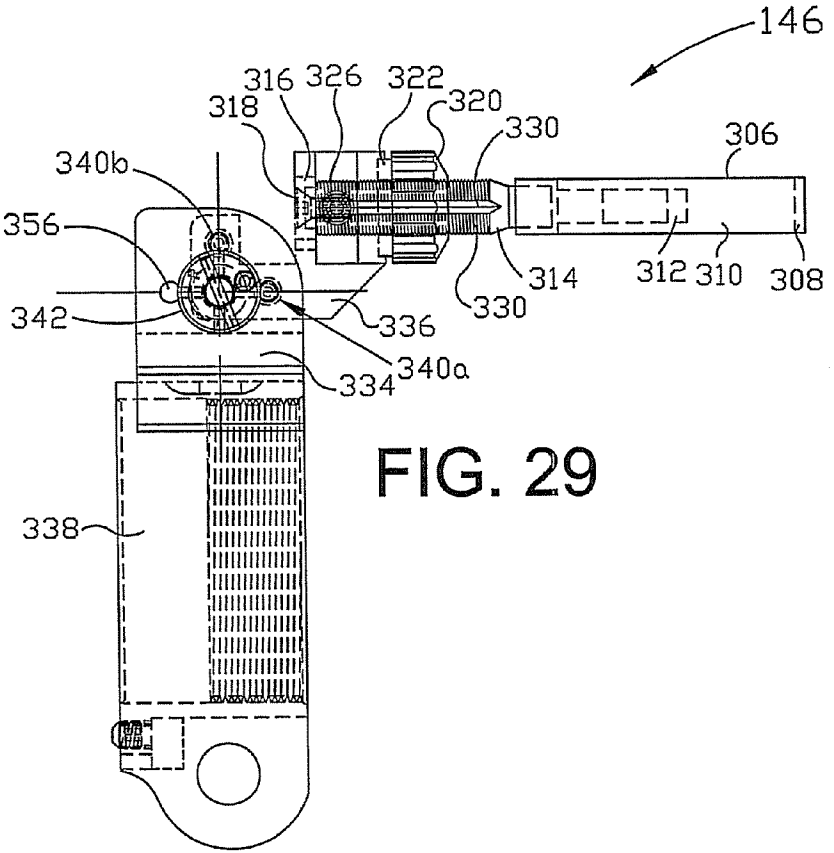
FIG. 29 is a full right-side view of the front sight assembly of FIG. 28 and showing the aperture arrangement in a stowing position as indicated by the arrow in FIG. 28.
Figure 28:
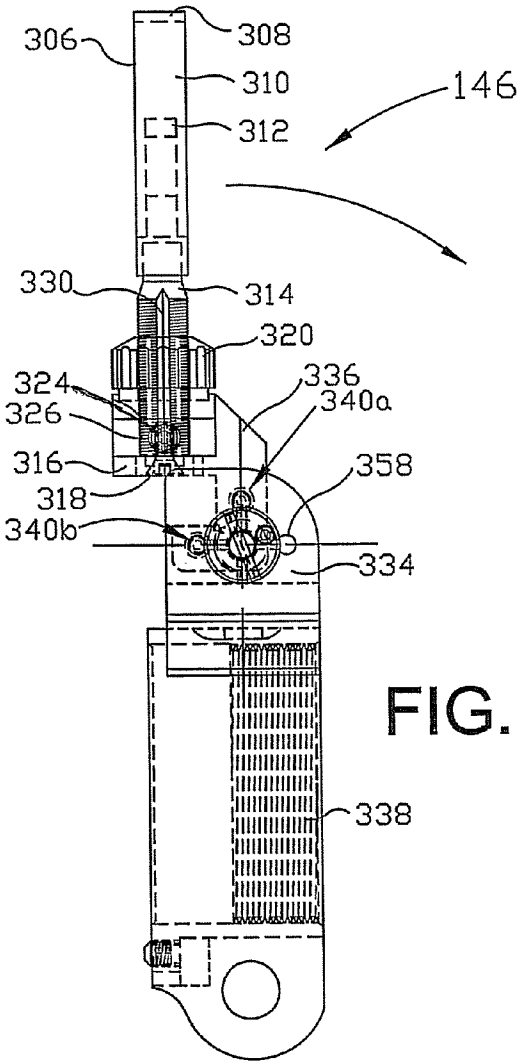
FIG. 28 is a full right-side view of the front sight assembly of FIG. 26.

As stated hereinabove, FIGS. 25-30*a* illustrate the front sight assembly 146 for use with the fixed rear sight assembly 142 of FIGS. 13*a*-18*b* or the movable rear sight assembly 144 of FIGS. 19*a*-24*b*. It is to be appreciated that some of the reference numbers may not be included in FIGS. 25-30*a* for clarity purposes. As particularly shown in FIG. 25, front sight assembly 146 includes an aperture member 306 having a circular aperture 308 which has a window 310 and a center post 312 which extends upwardly in window 310. Front sight assembly 146 further includes an elongated threaded shaft post 314 mounted in and connected to aperture member 306 at its one end and extending into a stop plate 316 and secured in stop plate 316 via a retaining screw 318. Mounted around elongated threaded shaft post 314 are a locking nut knob 320 and a washer 322 which may be bronze or brass. Locking nut knob 320 has an inner surface with threads that correspond to and engage the threads on elongated threaded shaft post 314. Locking nut knob 320 locks aperture member 306 in a fixed position. Aperture member 306 is rotated manually in a clockwise or a counter-clockwise direction about the longitudinal axis B in FIG. 25 to raise or lower the aperture member 306 and the locking nut knob 320 is then rotated to lock or fix aperture member 306 in position. A housing retainer 324 contains two V-shaped head plunger assemblies 326, one located diametrically opposite to the other relative to elongated threaded shaft 314 and each having a V-shaped head 328. The elongated threaded shaft post 314 has at least two elongated V-troughs 330, each located on diametrically opposite sides along the elongated threaded shaft post 314. Each V-shaped head 328 of V-shaped head plunger assembly 326 moves into and engages an elongated V-trough 330 of elongated threaded shaft post 314, as shown best in FIGS. 27-29. Each plunger assembly 326 has a spring 326*a* which forces the V-shaped head 328 into the elongated V-trough 330 to lock the elongated threaded shaft 314 in a desired elevational position. Plunger assemblies 326 operate upon each 180 degree turn of the aperture member 306. That is, plunger assemblies 326 are forced outwardly when they are rotated and then snap inwardly into the V-trough 330 to lock elongated shaft 314 at the end of each 180 degree turn. When aperture member 306 is in its desired position, locking nut knob 320 is turned until it abuts against washer 322. The enlarged "A" view of FIG. 25 is a top view and illustrates the engagement of the V-shaped head 328 of one plunger assembly 326 in an elongated V-shaped trough 330 located on opposite sides of elongated threaded shaft 314 (FIGS. 27-29).

Figure 36:
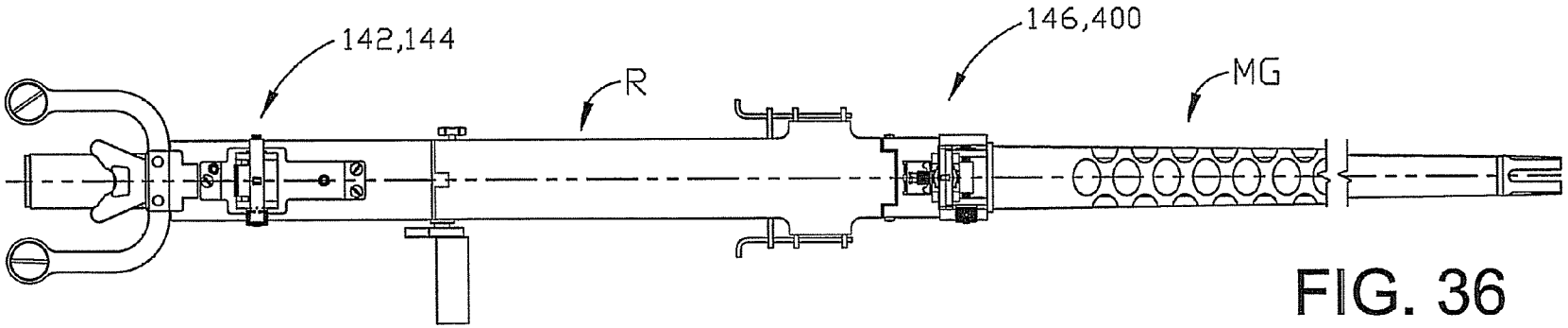
FIG. 36 is a top plan view illustrating the rear front assembly and the front sight assembly of the second embodiment of the present invention mounted on a receiver supporting a machine gun.
Figure 37:
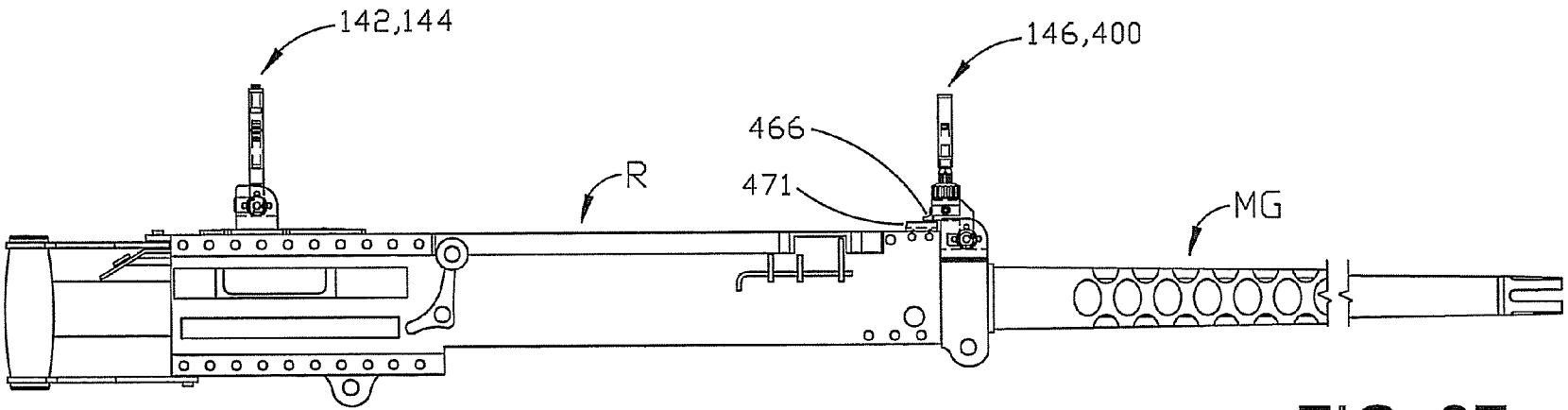
FIG. 37 is a side elevation view of FIG. 36.

As best shown in FIGS. 27, 28 and 29, elongated threaded shaft post 314 is mounted through a C-shaped member 336. Aperture member 306 of front sight assembly 146 is connected via the pivotal C-shaped member 336, which in turn is connected to a base support cradle 334. Base support cradle 334 preferably is TIG welded to a trunnion adapter 338 shown in FIGS. 26, 28 and 29 for attachment of the front sight assembly 146 onto a trunnion of the receiver R of the machine gun MG through means well known to those skilled in the art and as shown in FIGS. 36 and 37. The C-shaped member 336 contains the housing retainer 324 for housing the V-shaped head plunger assemblies 326.

Similar to the rear sight assemblies 142, 144 of this second embodiment, the front sight assembly 146 also has a detent plunger spring arrangement including a first detent plunger spring assembly 340*a* and a second detent plunger spring assembly 340*b* located at about a 90 degree angle relative to each other in pivotal C-shaped member 336 and a windage screw knob assembly 342, which operate similar to those described hereinabove. Detent plunger spring assemblies 340*a*, 340*b* include two opposed plunger members 344, 346 and a spring 348. Each plunger assembly 340*a*, 340*b* extends in a longitudinal opening 350, 352, respectively, located in the pivotal C-shaped member 336, which is attached to aperture member 306 with the two plunger members 344, 346 of each plunger assembly 340*a*, 340*b* (numbered in FIG. 30*a*) engage openings 354, 356 located in the two support members 334*a*, 334*b* of base support cradle 334. However, when aperture member 306 is pivoted 90 degrees as illustrated in FIG. 29, plunger members 344, 346 of detent plunger spring assembly 340*a* are received in openings 358 (FIG. 28) of support members 334*a*, 334*b*, respectively (FIG. 29), and plunger members 344, 346 of detent plunger spring assembly 340*b* are received in openings 354 of support members 334*a*, 334*b*, respectively. Referring particularly to FIGS. 27-29, as can be appreciated, openings 354, 356 in support members 334*a*, 334*b* are located at a 90 degree angle relative to each other and openings 356 and 358 are located at a 90 degree angle relative to each other as best shown in FIG. 27 so that plunger members 344, 346 of the detent plunger spring assemblies 340*a*, 340*b* may engage the appropriate openings 354, 356 and 358 when aperture member 306 of the front sight assembly 146 is pivoted to the right as indicated by the arrow in FIG. 28 for its stowing position and for an inoperative position of the machine gun MG or when aperture member 306 of front sight assembly is pivoted upright in its operative position and for an operative position of the machine gun MG, as illustrated in FIGS. 25, 26, 27, 28 and 30*a*.

As shown best in FIG. 25, the windage screw knob assembly 342 of front sight assembly 146 includes a knurled knob 362 mounted via a retaining roll pin 364 onto an elongated shaft 366 extending through the two support members 334*a*, 334*b* of base support cradle 334 and the lower pivotal C-shaped member 336 of aperture member 306. Elongated shaft 366 has a threaded portion which engages with the inner threads of a further longitudinal opening 370 of lower pivotal C-shaped member 336 of aperture member 306. Rotation of knob 362 rotates the elongated shaft 366 which causes the pivotal C-shaped member 336 and aperture member 306 to move transversely or laterally for windage purposes. As stated hereinabove, this windage screw knob assembly 342 is similar to those described hereinabove for the rear sight assembly 144 of FIGS. 19*a*-23. Windage screw knob assembly 342 is held in a fixed position via a spring assembly 343 which engages one of the V-shaped recesses in V-notched plate 345, as indicated particularly in FIG. 26.

Figure 30A:
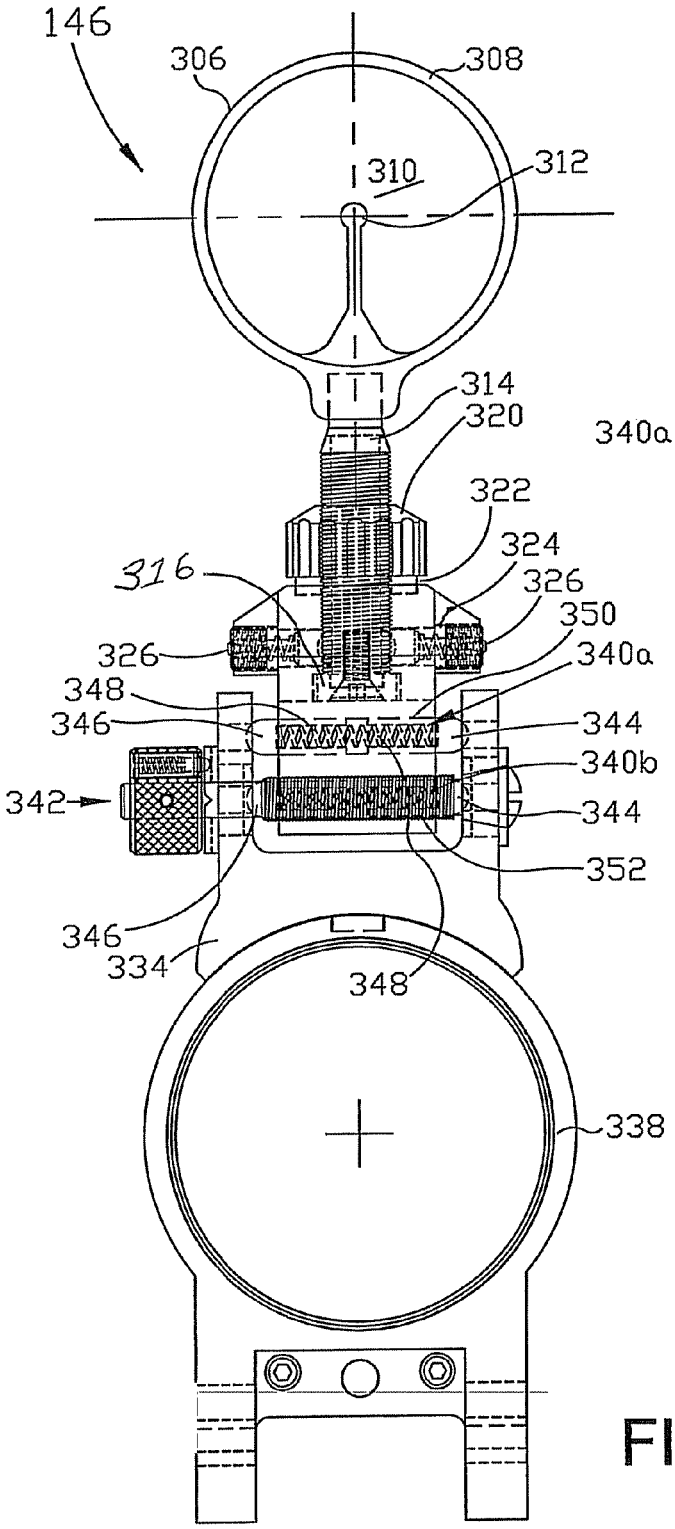
FIG. 30*a* is a full front view of the front sight assembly of FIG. 26.
Figure 30B:
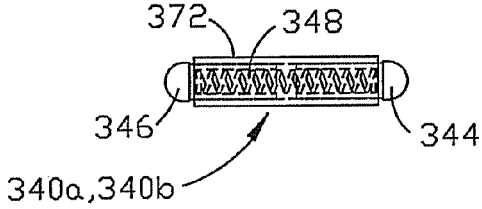
FIG. 30*b* is a front view of a detent plunger spring assembly for use in the movable front sight assembly of FIGS. 25-30*a* which may be used to repair the detent plunger spring assemblies of FIGS. 25-30*a;*

FIG. 30*b* shows that the detent plunger spring assemblies 340*a*, 340*b* of the front sight assembly 146 may also include a sleeve assembly 372 configured to receive the two plunger members 344, 346 and the spring 348. This arrangement may be used to repair or replace the detent plunger spring assemblies 340, 340*b* illustrated in FIGS. 25-30*a* particularly if the inner surface of the longitudinal openings 350, 352 of pivotal C-shaped member 336 (FIG. 27) wears after excessive use. If a repair is needed, sleeve assembly 372 may be inserted around plunger members 344, 346 and spring 348. The thickness of sleeve assembly 372 will be such as to take up any clearance existing between the inner surface of the longitudinal openings 350, 352 and the outer surfaces of plunger members 344, 346 of detent plunger spring assemblies 340*a*, 340*b* due to wear. It is also to be appreciated that the detent plunger spring assembly 204 of FIGS. 18*a* and 18*b* may also be used in the rear sight assembly 144 instead of the detent plunger spring assemblies 340*a*, 340*b* described herein.

Further, it is to be appreciated that the radial elements 158, 160 and 162 of rear sight assembly 142 and radial elements 234 of movable rear sight assembly 144, depending on which rear sight assembly is being used in conjunction with the front sight assembly 146, may be aligned with the circular aperture 308 of front sight assembly 146 so that aperture 156 of rear sight assembly 142 or aperture 232 of movable rear sight assembly 144 can be aligned with the center post 312 of the front sight assembly 146. Such alignment is achieved through rotation of the windage screw knob assembly of the movable rear sight assembly 144 and the front sight assembly 146 and through the rotation of locking nut knob 320 of the front sight assembly 146 by turning locking nut knob 320 counter-clockwise then grasping the top section of the aperture member 306 and turning it clockwise or counter-clockwise. On each half rotation, the V-shaped head plunger assemblies 326 lock the aperture member 306 in place thereby positioning the aperture member 306 perpendicularly to the receiver R of the machine gun MG (FIGS. 36 and 37) on each turn until a correct or desired elevation of aperture member 306 is achieved. Stop plate 316 at the bottom of aperture member 306 keeps aperture member 306 from exiting the pivotal C-shaped member 336 in an upward direction. The total adjustable travel for aperture member 306 is about 0.25 inch. When aperture member 306 is in its desired elevational positioning, then locking nut knob 320 is rotated until it engages washer 322. Retaining of the rear sight assemblies 142 and 144 and the front sight assembly 146 is achieved through their respective detent spring plunger assemblies as disclosed hereinabove.

FIGS. 33 and 34 illustrate a front sight assembly 400 which is similar to the front sight assembly 146 of FIGS. 25-30*a* except that an aperture member 402 is connected via a pivotal C-shaped member 404 to a one-piece base support cradle-trunnion adapter arrangement 406, which is used for the attachment of the front sight assembly 400 onto a trunnion of a receiver R of the machine gun MG of FIGS. 36 and 37 through means well known to those skilled in the art. It is to be appreciated that in the embodiment of FIGS. 25-30*a*, the base support cradle 334 and the trunnion adapter 338 are two separate pieces where the base support cradle 334 is TIG welded to the trunnion adapter 338; whereas in the embodiment of FIGS. 33 and 34, the base support cradle 408 and the trunnion adapter 410 constitute a one-piece construction indicated generally at reference number 406. This one-piece construction arrangement 406 may be machined out of 4140 chrome steel molly (mil. Spec). The other components of the front sight assembly 400 of FIGS. 33 and 34 are similar to the embodiment of FIGS. 25-30*a*.

More particularly, and with reference to FIG. 33, front sight assembly 400 includes aperture member 402 having an upper circular aperture 412 having a window 414 and a center post 416 extending upwardly in window 414. Front sight assembly 400 further includes an elongated threaded shaft post 418 mounted in and connected to aperture member 402 at its one end and extending into a stop plate 420 and secured in stop plate 420 via a retaining screw 422. Mounted around elongated threaded shaft post 418 are a locking nut knob 424 and a washer 426 which may be bronze or brass. Locking nut knob 424 has an inner surface with threads that correspond to and engage the threads on shaft 418. Locking nut knob 424 locks aperture member 402 in a fixed elevational position. Aperture member 402 is rotated manually in a clockwise or a counter-clockwise direction to raise and lower aperture member 402 and locking nut knob 424 is then rotated to lock or fix aperture member 402 in position.

A housing retainer 428 contains two V-shaped head plunger assemblies 430 (best shown in the enlarged view A of FIG. 33), one located diametrically opposite to the other relative to shaft 418 and each having a V-shaped head 432. The elongated threaded shaft post 418 has at least two elongated V-troughs 434, each located on diametrically opposite sides of elongated threaded shaft post 418. The V-shaped head 432 of the V-shaped head plunger assemblies 430 moves into and engages an elongated V-trough 434 of elongated threaded shaft 418, as shown best in FIG. 34. Each plunger assembly 430 has a spring 437 which forces the V-shaped head 432 into the elongated V-trough 434 to lock the elongated threaded shaft 418 in a desired elevational position. Plunger assemblies 430 operate upon each 180 degree turn of the aperture member 402. That is, plunger assemblies 430 are forced outwardly when aperture member 402 along with shaft 418 is rotated, preferably manually, and then plunger assemblies 430 snap inwardly into the V-troughs 434 to lock the elongated shaft 418 at the end of each 180 degree turn in either a clockwise or counter-clockwise rotation of aperture member 402. When aperture member 402 is rotated into its desired position, locking nut knob 424 is turned, preferably manually, until locking nut knob 424 abuts against washer 426. The enlarged A view of FIG. 33 is a top view and illustrates the engagement of the V-shaped head 432 of one plunger assembly 430 in an elongated V-shaped trough 434 located on opposite sides of elongated threaded shaft 418 (FIG. 34).

As shown in FIGS. 33 and 34, and as discussed hereinabove, elongated threaded shaft post 418 is mounted through a C-shaped member 404. Aperture member 402 of front sight assembly 400 is connected via the elongated threaded shaft post 418 to the pivotal C-shaped member 404, which, in turn, is connected to the one-piece base support cradle-trunnion adapter arrangement 406. The cradle-trunnion adapter arrangement 406 is used for the attachment of the front sight assembly 400 onto a trunnion (not shown) of a receiver R of the machine gun MG (FIGS. 36 and 37) through means well known to those skilled in the art. The C-shaped member 404 contains the housing retainer 428 for the V-shaped head plunger assemblies 430.

As best shown in FIG. 33, front sight assembly 400 also has a detent plunger spring arrangement including a first detent plunger spring assembly 436 and a second detent plunger spring assembly 438 located at about a 90 degree angle relative to each other in pivotal C-shaped member 404 and a windage screw knob assembly 440, which operates similar to those described hereinabove. Detent plunger spring assemblies 436, 438 include two opposed plunger members 442, 444 and a spring 446. Each plunger assembly 436, 438 extends in a longitudinal opening 448, 450, respectively (best shown in FIG. 34), located in the pivotal C-shaped member 404, which is attached to aperture member 402 with the two plunger members 442, 444 of each plunger assembly 436, 438 (numbered in FIG. 33) engaging openings 448, 450 located in base support cradle 408. However, when aperture member 402 is pivoted 90 degrees as indicated by the arrow in FIG. 34, plunger members 442, 444 of detent plunger spring assembly 436 are received in openings 452 of base support cradle 408, and plunger members 442, 444 of detent plunger spring assembly 438 are received in openings 448 of base support cradle 408, respectively. Openings 448 and 452 in base support cradle 408 are located at a 90 degree angle relative to each other and openings 448 and 450 are located at a 90 degree angle relative to each other as best shown in FIG. 34 so that plunger members 442, 444 of the detent plunger spring assemblies 436, 438 may engage the appropriate openings 448, 450 and 452 when aperture member 402 is pivoted to the right as indicated by the arrow in FIG. 34 for its stowing position or when aperture member 402 is pivoted upright in its operative position illustrated in FIGS. 33 and 34.

As shown best in FIG. 33, the windage screw knob assembly 440 includes a knurled knob 454 mounted via a retaining roll pin 456 onto an elongated shaft 458 extending through base support cradle 408 and C-shaped member 404 supporting aperture member 402. Elongated shaft 458 has a threaded portion which engages with the inner threads of a further longitudinal opening 460 (FIG. 34) of C-shaped member 404. Rotation of knob 454 rotates the elongated shaft 458 which causes the C-shaped member 404 and aperture member 402 to move transversely or laterally for windage purposes. As stated hereinabove, this windage screw knob assembly 440 is similar to those described hereinabove for the rear sight assembly 144 of FIGS. 19*a*-23. Windage screw knob assembly 440 is held in a fixed position via a spring assembly 462 which engages one of the V-shaped recesses in V-notched plate 464 as indicated particularly in FIG. 33.

Referring particularly to FIGS. 33, 34 and 35, a windage indicator 466 with a pointer 468 (FIG. 35) is attached to the C-shaped member 404 via screws 470 as best shown in FIG. 35. A trunnion cover 471 with a windage scale plate 472 is associated with the windage indicator 466 as best shown in FIG. 35. As indicated in FIG. 34, trunnion cover 471 and windage scale plate 472 are attached to the top of trunnion of the receiver R of the machine gun MG (FIGS. 36 and 37). As is apparent, the extent of the transverse or lateral movement of C-shaped member 404 and aperture member 402 to the right or left of the longitudinal plane of receiver R and therefore machine gun MG will be indicated via pointer 468 of windage indicator 466 and its alignment with the lines numbered 5-0-5 on windage scale plate 472. It is to be appreciated that this windage indicator 466 and windage scale plate 472 may be used with the other embodiments of the invention.

It is to be further appreciated that optionally the front and rear sight assemblies disclosed herein may be used with existing front and rear sight assemblies. That is, optionally front sight assembly 12 of FIGS. 31 and 32 may in some instances be used in conjunction with additional designs for a rear sight assembly other than the rear sight assembly 10 disclosed herein, and optionally, rear sight assembly 10 of FIGS. 31 and 32 may in some instances be used in conjunction with additional designs for a front sight assembly other than the front sight assembly 12 disclosed herein. Additionally, optionally, front sight assemblies 146 and 400 of FIGS. 36 and 37 may in some instances be used in conjunction with additional designs for a rear sight assembly other than the rear sight assemblies 142 and 144 disclosed herein, and optionally, rear sight assemblies 142 and 144 of FIGS. 36 and 37 may in some instances be used in conjunction with additional designs for a front sight assembly other than the front sight assemblies 146 and 400 disclosed herein.

Although the present invention has been described with reference to particular embodiments of a sighting system for particular use on a machine gun, those skilled in the art may make modifications and alterations to the present invention without departing from the spirit and scope of the invention. Accordingly, the foregoing detailed description is intended to be illustrative rather than restrictive. The invention is defined by the appended claims, and all changes to the invention that fall within the meaning and range of equivalency of the claims are embraced within their scope.

The invention claimed is:

1. A sighting system for a machine gun, comprising:

a front sight assembly configured for lateral movement perpendicular to a longitudinal plane of the machine gun and including a first aperture member configured to be raised and lowered relative to the longitudinal plane of the machine gun, and including at least one detent spring loaded plunger assembly operatively connected to the first aperture member for registering and retaining the first aperture member in a fixed position relative to a line-of-sight while the machine gun is being operated; and a rear sight assembly comprising a second aperture member, a base support cradle for supporting the second aperture member and at least one detent plunger spring assembly operatively connected to the second aperture member for registering and retaining the second aperture member in a fixed position within the base support cradle and relative to a line-of-sight while the machine gun is being operated;

wherein the second aperture member of the rear sight assembly has a longitudinal opening and wherein the detent plunger spring assembly of the rear sight assembly operatively connected to the second aperture member extends through the longitudinal opening of the second aperture member and is comprised of at least two plunger members, a guide rod and a spring mounted on each end of the guide rod, and wherein the guide rod extends between and into its two opposed ends with the spring extending into one of the two plunger members, and wherein the rear sight assembly is configured for lateral windage movement within the base support cradle and further includes a windage screw assembly fixedly secured in the base support cradle and having an elongated shaft with a threaded portion extending longitudinally through the second aperture member and a knob for rotating the elongated shaft and its threaded portion for the lateral movement of the aperture second member along the threaded portion of the elongated shaft of the windage screw assembly and within the base support cradle.

2. The sighting system of claim 1, wherein the windage screw assembly further includes a detent screw/plunger assembly located in the knob and a bushing member having a plurality of recesses for receiving and retaining the plunger of the detent screw/plunger assembly for preventing rotation of the knob and the elongated shaft of the windage screw assembly.

3. A sighting system for a machine gun, comprising:

a front sight assembly configured for lateral movement perpendicular to a longitudinal plane of the machine gun and including a first aperture member configured to be raised and lowered relative to the longitudinal plane of the machine gun, and including at least one detent spring loaded plunger assembly operatively connected to the first aperture member for registering and retaining the first aperture member in a fixed position relative to a line-of-sight while the machine gun is being operated; and a rear sight assembly comprising a second aperture member, a base support cradle for supporting the second aperture member and at least one detent plunger spring assembly operatively connected to the second aperture member for registering and retaining the second aperture member in a fixed position within the base support cradle and relative to a line-of-sight while the machine gun is being operated;

wherein the second aperture member of the rear sight assembly has a longitudinal opening and wherein the detent plunger spring assembly of the rear sight assembly operatively connected to the second aperture member extends through the longitudinal opening of the second aperture member and is comprised of at least two plunger members, a guide rod and a spring mounted on each end of the guide rod, and wherein the guide rod extends between and into its two opposed ends with the spring extending into one of the two plunger members, and wherein the first aperture member of the front sight assembly has an upper arched portion which defines a window in which a sight post extends upwardly, and wherein the front sight assembly further comprises:

a first base member attached to the first aperture member of the front sight assembly and having a dovetail surface; and a second base member having a dovetail surface corresponding to that of and slidable within the dovetail surface of the first base member for the lateral movement of the first aperture member and the first base member of the front sight assembly relative to the longitudinal plane of the machine gun;

and wherein the sight post of the front sight assembly has an external threaded portion, and wherein the front sight assembly further comprises an elevation knob having an internal threaded portion in engagement with the external threaded portion of the sight post for the raising and lowering of the sight post within the window of the first aperture member of the front sight assembly upon rotation of the elevation knob.

4. The sighting system of claim 3, wherein the elevation knob of the front sight assembly includes a surface having a plurality of recesses, wherein the front sight assembly further comprises at least two detent spring loaded plunger assemblies located diametrically opposite each other relative to the sight post, and wherein the plunger of the each detent spring loaded plunger assembly engages in and is retained in one of the recesses of the elevation knob upon rotation of the elevation knob upon the raising and the lowering of the sight post.

5. A gun having a sighting system, the sighting system comprising:

a front sight assembly configured for lateral movement perpendicular to a longitudinal plane of the gun and including a sight post configured to be raised and lowered in a plane perpendicular to the longitudinal plane of the gun and including a detent spring loaded plunger assembly system operatively connected to a first aperture member for registering and retaining the first aperture member in a fixed position relative to a line-of-sight while the machine gun is being operated; and a rear sight assembly comprising a second aperture member, a base support cradle for supporting the second aperture member and at least one detent plunger spring assembly operatively connected to the second aperture member for registering and retaining the second aperture member in a fixed position within the base support cradle and relative to a line-of-sight while the gun is being operated;

wherein the second aperture member of the rear sight assembly has a longitudinal opening and wherein the detent plunger spring assembly of the rear sight assembly operatively connected to the second aperture member extends through the longitudinal opening of the second aperture member and is comprised of at least two plunger members, a guide rod and a spring mounted on each end of the guide rod, and wherein the guide rod extends between and into its two opposed ends with the spring extending into one of the two plunger members, and wherein the rear sight assembly is configured for lateral windage movement within the base support cradle and further includes a windage screw assembly fixedly secured in the base support cradle and having an elongated shaft with a threaded portion extending longitudinally through the second aperture member and a knob for rotating the elongated shaft and its threaded portion for the lateral movement of the second aperture member along the threaded portion of the elongated shaft of the windage screw assembly and within the base support cradle.

6. The gun of claim 5, wherein the windage screw assembly further includes a detent screw/plunger assembly located in the knob and a bushing member having a plurality of recesses for receiving and retaining the plunger of the detent screw/plunger assembly for preventing rotation of the knob and the elongated shaft.

7. A gun having a sighting system, the sighting system comprising:

a front sight assembly configured for lateral movement perpendicular to a longitudinal plane of the gun and including a sight post configured to be raised and lowered in a plane perpendicular to the longitudinal plane of the gun and including a detent spring loaded plunger assembly system operatively connected to a first aperture member for registering and retaining the first aperture member in a fixed position relative to a line-of-sight while the machine gun is being operated; and a rear sight assembly comprising a second aperture member, a base support cradle for supporting the second aperture member and at least one detent plunger spring assembly operatively connected to the second aperture member for registering and retaining the second aperture member in a fixed position within the base support cradle and relative to a line-of-sight while the gun is being operated;

wherein the second aperture member of the rear sight assembly has a longitudinal opening and wherein the detent plunger spring assembly of the rear sight assembly operatively connected to the second aperture member extends through the longitudinal opening of the second aperture member and is comprised of at least two plunger members, a guide rod and a spring mounted on each end of the guide rod, and wherein the guide rod extends between and into its two opposed ends with the spring extending into one of the two plunger members;

wherein the first aperture member of the front sight assembly has an upper arched portion which defines a window in which the sight post extends upwardly, and wherein the front sight assembly further comprises:

a first base member attached to the first aperture member of the front sight assembly and having a dovetail surface; and a second base member having a dovetail surface corresponding to that of and slidable within the dovetail surface of the first base member for the lateral movement of the first aperture member and the first base member of the front sight assembly relative to the longitudinal plane of the gun;

and wherein the sight post of the front sight assembly has an external threaded portion, and wherein the front sight assembly further comprises an elevation knob having an internal threaded portion in engagement with the external threaded portion of the sight post for the raising and lowering of the sight post within the window of the first aperture member of the front sight assembly upon rotation of the elevation knob.

8. The gun of claim 7, wherein the elevation knob of the front sight assembly includes a surface having a plurality of recesses, and wherein the front sight assembly further comprises at least two detent spring loaded plunger assemblies located diametrically opposite each other relative to the sight post, and wherein the plunger of each detent spring loaded plunger assembly engages in and is retained in one of the recesses of the elevation knob upon rotation of the elevation knob upon the raising and the lowering of the sight post.

9. A sighting system for a machine gun, comprising:

a front sight assembly configured for lateral windage movement perpendicular to a longitudinal plane of the machine gun and including an aperture arrangement configured to be raised and lowered in a plane perpendicular to the longitudinal plane of the machine gun; and a rear sight assembly comprising an aperture member, a base support cradle for supporting the aperture member and a detent plunger spring arrangement operative connected to the aperture member for registering and retaining the aperture member in a fixed position within the base support cradle and relative to a line-of-sight while the machine gun is being operated;

wherein the front sight assembly further comprises a base support cradle for pivotally supporting the aperture arrangement and a detent plunger spring arrangement operatively connected to the aperture arrangement of the front sight assembly for registering and retaining the aperture arrangement of the front sight assembly in a fixed position within the base support cradle and relative to a line-of-sight while the machine gun is being operated; and wherein the aperture arrangement of the front sight assembly includes a C-shaped member pivotally mounted in the base support cradle; an elongated threaded shaft post mounted through the C-shaped member and connected to a circular aperture having a window and a center post extending upwardly in the window; a V-shaped head plunger arrangement for locking the circular aperture and the center post in an elevational position upon each rotation of the circular aperture; and a locking nut knob with internal threads that engage the elongated threaded shaft post for locking the circular aperture and the center post of the aperture arrangement of the front sight assembly in a desired elevational position.

10. The sighting system of claim 9, wherein the aperture member of the rear sight assembly includes an L-shaped pivotal member having a first leg with an aperture and a first longitudinal opening and a second leg with a second longitudinal opening;

wherein the detent plunger spring arrangement of the rear sight assembly includes a first detent plunger spring assembly and a second detent plunger spring assembly; and wherein the first detent plunger spring assembly of the rear sight assembly extends longitudinally through the first longitudinal opening of the first leg, and the second detent plunger spring assembly of the rear sight assembly extends longitudinally through the second longitudinal opening of the second leg of the aperture member.

11. The sighting system of claim 10, wherein the first detent plunger spring assembly of the rear sight assembly is comprised of at least two opposed plunger members and a spring extending between and into the two plunger members, and wherein the second detent plunger spring assembly of the rear sight assembly is comprised of at least two opposed plunger members and a spring extending between and into the two plunger members.

12. The sighting system of claim 10, wherein the first detent plunger spring assembly of the rear sight assembly is further comprised of a sleeve configured to receive the two opposed plunger members and the spring extending between and into the two plunger members and configured to extend through the first longitudinal opening of the first leg of the L-shaped pivotal member of the aperture member, and wherein the second detent plunger spring assembly of the rear sight assembly is further comprised of a sleeve configured to receive the two opposed plunger members and the spring extending between and into the two plunger members and configured to extend through the second longitudinal opening of the second leg of the L-shaped pivotal member of the aperture member.

13. The sighting system of claim 10, wherein the first detent plunger spring assembly of the rear sight assembly is comprised of at least two plunger members, a guide rod and a spring mounted on each end of the guide rod, and wherein the guide rod extends between and into its two opposed ends with the spring extending into one of the two plunger members, and wherein the second detent plunger spring assembly of the rear sight assembly is comprised of at least two plunger members, a guide rod and a spring mounted on each end of the guide rod, and wherein the guide rod extends between and into its two opposed ends with the spring extending into one of the two plunger members.

14. The sighting system of claim 10, wherein the machine gun includes a receiver and wherein the rear sight assembly further includes a base plate for supporting the aperture member and the base support cradle on top of the receiver.

15. The sighting system of claim 10, wherein the rear sight assembly is configured for lateral windage movement within the base support cradle and further includes a windage screw assembly fixedly secured in the base support cradle and having an elongated shaft with a threaded portion extending longitudinally through the aperture member and a knob for rotating the elongated shaft and its threaded portion for the lateral movement of the aperture member along the threaded portion of the elongated shaft of the windage screw assembly and within the base support cradle.

16. The sighting system of claim 15, wherein the windage screw assembly further includes a detent screw/plunger assembly located in the knob and a bushing member having recesses for receiving and retaining the plunger of the detent screw/plunger assembly for preventing rotation of the knob and the elongated shaft of the windage screw assembly.

17. The sighting system of claim 9, further comprising a trunnion adapter for attachment of the front sight assembly to the machine gun, and wherein the base support cradle of the front sight assembly and the trunnion adapter are two separate pieces.

18. The sighting system of claim 9, further comprising a trunnion adapter for attachment of the front sight assembly to the machine gun, and wherein the base support cradle of the front sight assembly and the trunnion adapter constitute a one-piece construction.

19. The sighting system of claim 9, wherein the front sight assembly further includes a windage screw assembly fixedly secured in the base support cradle and having an elongated shaft with a threaded portion extending longitudinally through the aperture arrangement and a knob for rotating the elongated shaft and its threaded portion for the lateral windage movement of the aperture arrangement along the threaded portion of the elongated shaft of the windage screw assembly and within the base support cradle.

20. The sighting system of claim 19, wherein the windage screw assembly further includes a detent screw/plunger assembly located in the knob and a bushing member having a plurality of recesses for receiving and retaining the plunger of the detent screw/plunger assembly for preventing rotation of the knob and the elongated shaft of the windage screw assembly.

21. The sighting system of claim 9, wherein the detent plunger spring arrangement of the front sight assembly includes a first detent plunger spring assembly and a second detent plunger spring assembly; and wherein the first detent plunger spring assembly and the second detent plunger spring assembly of the front sight assembly includes at least two opposed plunger members and a spring extending between and into the two plunger members.

22. The sighting system of claim 21, wherein the first detent plunger spring assembly and the second detent plunger spring assembly of the front sight assembly further includes a sleeve configured to receive the two opposed plunger members and the spring extending between and into the two plunger members and to extend through the aperture arrangement.

23. The sighting system of claim 9, wherein the detent plunger spring arrangement of the front sight assembly includes a first detent plunger spring assembly and a second detent plunger spring assembly; and wherein the first detent plunger spring assembly and the second detent plunger spring assembly include at least two plunger members, a guide rod and a spring mounted on each end of the guide rod; and wherein the guide rod extends between and into its two opposed ends with the spring extending into one of the two plunger members.

24. The sighting system of claim 9, wherein the detent plunger spring arrangement of the front sight assembly includes a first detent plunger spring assembly and a second detent plunger spring assembly; and wherein the first detent plunger spring assembly and the second detent plunger spring assembly include at least two plunger members, a guide rod and a spring mounted on each end of the guide rod; and wherein the guide rod extends between and into its two opposed ends with the spring extending into one of the two plunger members.

25. The sighting system of claim 9, wherein at least the front sight assembly includes a windage indicator and a windage scale plate.

26. The sighting system of claim 9, wherein the elongated threaded shaft post of the front sight assembly includes at least one elongated V-trough and wherein the V-shaped head plunger arrangement includes at least one V-shaped head plunger assembly; and wherein the at least one V-shaped head plunger assembly is forced into the elongated V-trough of the elongated threaded shaft post upon rotation of the circular aperture for the locking of upper circular aperture and the center post of the front sight assembly in an elevational position.

27. The sighting system of claim 9, wherein the elongated threaded shaft post of the front sight assembly includes at least two elongated V-troughs and wherein the V-shaped head plunger arrangement includes at least two V-shaped head plunger assemblies, each V-trough located on diametrically opposite sides of the elongated threaded shaft post, and wherein each V-shaped head plunger assembly is forced into one of the elongated V-troughs of the elongated threaded shaft post upon rotation of the circular aperture for the locking of the circular aperture and the center post of the front sight assembly in an elevational position.

28. The sighting system of claim 9, wherein the detent plunger spring arrangement of the front sight assembly includes a first detent plunger spring assembly and a second detent plunger spring assembly; wherein the C-shaped member of the aperture arrangement of the front sight assembly includes a first longitudinal opening for retaining the first detent plunger spring assembly and a second longitudinal opening for retaining the second detent plunger spring assembly; and wherein the base support cradle further includes first openings, second openings located 90 degrees relative to the first openings, and third openings located about 90 degrees relative to the second openings; and wherein the first detent plunger spring assembly of the front sight assembly engages the first openings of the base support cradle and the second detent plunger spring assembly of the front sight assembly engages the second openings of the base support cradle when the aperture arrangement of the front sight assembly is in an operative position for the operation of the machine gun and wherein the first detent plunger spring assembly of the front sight assembly engages the second openings of the base support cradle and the second detent plunger spring assembly of the front sight assembly engages the third openings of the base support cradle when the aperture arrangement of the front sight assembly is in an inoperative or stow away position.

29. A sighting system for a machine gun, comprising:

a front sight assembly configured for lateral movement perpendicular to a longitudinal plane of the machine gun and including a first aperture member configured to be raised and lowered relative to the longitudinal plane of the machine gun, and including at least one detent spring loaded plunger assembly operatively connected to the first aperture member for registering and retaining the first aperture member in a fixed position relative to a line-of-sight while the machine gun is being operated; and a rear sight assembly comprising a second aperture member, a base support cradle for supporting the second aperture member and at least one detent plunger spring assembly operatively connected to the second aperture member for registering and retaining the second aperture member in a fixed position within the base support cradle and relative to a line-of-sight while the machine gun is being operated;

wherein the rear sight assembly is configured for lateral windage movement within the base support cradle and further includes a windage screw assembly fixedly secured in the base support cradle and having an elongated shaft with a threaded portion extending longitudinally through the second aperture member and a knob for rotating the elongated shaft and its threaded portion for the lateral movement of the aperture second member along the threaded portion of the elongated shaft of the windage screw assembly and within the base support cradle; and wherein the windage screw assembly further includes a detent screw/plunger assembly located in the knob and a bushing member having a plurality of recesses for receiving and retaining the plunger of the detent screw/plunger assembly for preventing rotation of the knob and the elongated shaft of the windage screw assembly.

30. A sighting system for a machine gun, comprising:

a front sight assembly configured for lateral movement perpendicular to a longitudinal plane of the machine gun and including a first aperture member configured to be raised and lowered relative to the longitudinal plane of the machine gun, and including at least one detent spring loaded plunger assembly operatively connected to the first aperture member for registering and retaining the first aperture member in a fixed position relative to a line-of-sight while the machine gun is being operated; and a rear sight assembly comprising a second aperture member, a base support cradle for supporting the second aperture member and at least one detent plunger spring assembly operatively connected to the second aperture member for registering and retaining the second aperture member in a fixed position within the base support cradle and relative to a line-of-sight while the machine gun is being operated;

wherein the first aperture member of the front sight assembly has an upper arched portion which defines a window in which a sight post extends upwardly, and wherein the front sight assembly further comprises a first base member attached to the first aperture member of the front sight assembly and having a dovetail surface and a second base member having a dovetail surface corresponding to that of and slidable within the dovetail surface of the first base member for the lateral movement of the first aperture member and the first base member of the front sight assembly relative to the longitudinal plane of the machine gun;

wherein the sight post of the front sight assembly has an external threaded portion, and wherein the front sight assembly further comprises an elevation knob having an internal threaded portion in engagement with the external threaded portion of the sight post for the raising and lowering of the sight post within the window of the first aperture member of the front sight assembly upon rotation of the elevation knob; and wherein the elevation knob of the front sight assembly includes a surface having a plurality of recesses and the front sight assembly further comprises at least two detent spring loaded plunger assemblies located diametrically opposite each other relative to the sight post, and wherein the plunger of the each detent spring loaded plunger assembly engages in and is retained in one of the recesses of the elevation knob upon rotation of the elevation knob upon the raising and the lowering of the sight post.

31. A gun having a sighting system, the sighting system comprising:

a front sight assembly configured for lateral movement perpendicular to a longitudinal plane of the gun and including a sight post configured to be raised and lowered in a plane perpendicular to the longitudinal plane of the gun and including a detent spring loaded plunger assembly system operatively connected to a first aperture member for registering and retaining the first aperture member in a fixed position relative to a line-of-sight while the machine gun is being operated; and a rear sight assembly comprising a second aperture member, a base support cradle for supporting the second aperture member and at least one detent plunger spring assembly operatively connected to the second aperture member for registering and retaining the second aperture member in a fixed position within the base support cradle and relative to a line-of-sight while the gun is being operated;

wherein the rear sight assembly is configured for lateral windage movement within the base support cradle and further includes a windage screw assembly fixedly secured in the base support cradle and having an elongated shaft with a threaded portion extending longitudinally through the second aperture member and a knob for rotating the elongated shaft and its threaded portion for the lateral movement of the second aperture member along the threaded portion of the elongated shaft of the windage screw assembly and within the base support cradle; and wherein the windage screw assembly further includes a detent screw/plunger assembly located in the knob and a bushing member having a plurality of recesses for receiving and retaining the plunger of the detent screw/plunger assembly for preventing rotation of the knob and the elongated shaft.

32. A gun having a sighting system, the sighting system comprising:

a front sight assembly configured for lateral movement perpendicular to a longitudinal plane of the gun and including a sight post configured to be raised and lowered in a plane perpendicular to the longitudinal plane of the gun and including a detent spring loaded plunger assembly system operatively connected to a first aperture member for registering and retaining the first aperture member in a fixed position relative to a line-of-sight while the machine gun is being operated; and a rear sight assembly comprising a second aperture member, a base support cradle for supporting the second aperture member and at least one detent plunger spring assembly operatively connected to the second aperture member for registering and retaining the second aperture member in a fixed position within the base support cradle and relative to a line-of-sight while the gun is being operated;

wherein the first aperture member of the front sight assembly has an upper arched portion which defines a window in which the sight post extends upwardly, and wherein the front sight assembly further comprises a first base member attached to the first aperture member of the front sight assembly and having a dovetail surface and a second base member having a dovetail surface corresponding to that of and slidable within the dovetail surface of the first base member for the lateral movement of the first aperture member and the first base member of the front sight assembly relative to the longitudinal plane of the gun;

wherein the sight post of the front sight assembly has an external threaded portion, and wherein the front sight assembly further comprises an elevation knob having an internal threaded portion in engagement with the external threaded portion of the sight post for the raising and lowering of the sight post within the window of the first aperture member of the front sight assembly upon rotation of the elevation knob; and wherein the elevation knob of the front sight assembly includes a surface having a plurality of recesses and the front sight assembly further comprises at least two detent spring loaded plunger assemblies located diametrically opposite each other relative to the sight post, and wherein the plunger of each detent spring loaded plunger assembly engages in and is retained in one of the recesses of the elevation knob upon rotation of the elevation knob upon the raising and the lowering of the sight post.

33. A sighting system for a machine gun, comprising:

a front sight assembly configured for lateral windage movement perpendicular to a longitudinal plane of the machine gun and including an aperture arrangement configured to be raised and lowered in a plane perpendicular to the longitudinal plane of the machine gun; and a rear sight assembly comprising an aperture member, a base support cradle for supporting the aperture member and a detent plunger spring arrangement operative connected to the aperture member for registering and retaining the aperture member in a fixed position within the base support cradle and relative to a line-of-sight while the machine gun is being operated;

wherein the aperture member of the rear sight assembly includes an L-shaped pivotal member having a first leg with an aperture and a first longitudinal opening and a second leg with a second longitudinal opening;

wherein the detent plunger spring arrangement of the rear sight assembly includes a first detent plunger spring assembly and a second detent plunger spring assembly;

wherein the first detent plunger spring assembly of the rear sight assembly extends longitudinally through the first longitudinal opening of the first leg, and the second detent plunger spring assembly of the rear sight assembly extends longitudinally through the second longitudinal opening of the second leg of the aperture member;

wherein the rear sight assembly is configured for lateral windage movement within the base support cradle and further includes a windage screw assembly fixedly secured in the base support cradle and having an elongated shaft with a threaded portion extending longitudinally through the aperture member and a knob for rotating the elongated shaft and its threaded portion for the lateral movement of the aperture member along the threaded portion of the elongated shaft of the windage screw assembly and within the base support cradle; and wherein the windage screw assembly further includes a detent screw/plunger assembly located in the knob and a bushing member having recesses for receiving and retaining the plunger of the detent screw/plunger assembly for preventing rotation of the knob and the elongated shaft of the windage screw assembly.

34. A sighting system for a machine gun, comprising:

a front sight assembly configured for lateral windage movement perpendicular to a longitudinal plane of the machine gun and including an aperture arrangement configured to be raised and lowered in a plane perpendicular to the longitudinal plane of the machine gun; and a rear sight assembly comprising an aperture member, a base support cradle for supporting the aperture member and a detent plunger spring arrangement operative connected to the aperture member for registering and retaining the aperture member in a fixed position within the base support cradle and relative to a line-of-sight while the machine gun is being operated;

wherein the front sight assembly further comprises a base support cradle for pivotally supporting the aperture arrangement and a detent plunger spring arrangement operatively connected to the aperture arrangement of the front sight assembly for registering and retaining the aperture arrangement of the front sight assembly in a fixed position within the base support cradle and relative to a line-of-sight while the machine gun is being operated;

wherein the front sight assembly further includes a windage screw assembly fixedly secured in the base support cradle and having an elongated shaft with a threaded portion extending longitudinally through the aperture arrangement and a knob for rotating the elongated shaft and its threaded portion for the lateral windage movement of the aperture arrangement along the threaded portion of the elongated shaft of the windage screw assembly and within the base support cradle; and wherein the windage screw assembly further includes a detent screw/plunger assembly located in the knob and a bushing member having a plurality of recesses for receiving and retaining the plunger of the detent screw/plunger assembly for preventing rotation of the knob and the elongated shaft of the windage screw assembly.

* * * * *